US008596753B2

(12) United States Patent
Yamaguchi et al.

(10) Patent No.: US 8,596,753 B2
(45) Date of Patent: Dec. 3, 2013

(54) NOZZLE SURFACE CLEANING APPARATUS AND DROPLET EJECTION APPARATUS

(75) Inventors: Eiichiro Yamaguchi, Kanagawa-ken (JP); Hiroshi Inoue, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 13/073,361

(22) Filed: Mar. 28, 2011

(65) Prior Publication Data

US 2011/0234693 A1 Sep. 29, 2011

(30) Foreign Application Priority Data

Mar. 29, 2010 (JP) ..... 2010-075490

(51) Int. Cl.
*B41J 2/165* (2006.01)

(52) U.S. Cl.
USPC ..... 347/29; 347/32; 347/33; 347/28

(58) Field of Classification Search
USPC ..... 347/29, 32, 33, 28
See application file for complete search history.

(56) References Cited

U.S. PATENT DOCUMENTS

| | | | | |
|---|---|---|---|---|
| 5,539,435 | A * | 7/1996 | Uchida et al. | 347/33 |
| 6,213,582 | B1 | 4/2001 | Uchida et al. | |
| 6,688,722 | B2 | 2/2004 | Uchida et al. | |
| 7,510,265 | B2 * | 3/2009 | Kang et al. | 347/33 |
| 2003/0231222 | A1 * | 12/2003 | Jefferson et al. | 347/29 |
| 2008/0158291 | A1 | 7/2008 | Satake | |
| 2009/0021553 | A1 | 1/2009 | Ishimatsu | |
| 2009/0189945 | A1 * | 7/2009 | Sekiyama | 347/33 |
| 2013/0088544 | A1 | 4/2013 | Ishimatsu | |

FOREIGN PATENT DOCUMENTS

| | | | |
|---|---|---|---|
| JP | 3-262646 | A | 11/1991 |
| JP | 2002-19132 | A | 1/2002 |
| JP | 2006-205712 | A | 8/2006 |
| JP | 2006-224359 | A | 8/2006 |
| JP | 2006-248102 | A | 9/2006 |
| JP | 2008-179125 | A | 8/2008 |
| JP | 2009-23118 | A | 2/2009 |
| JP | 2010-5856 | A | 1/2010 |

* cited by examiner

*Primary Examiner* — Henok Legesse
(74) *Attorney, Agent, or Firm* — Birch, Stewart, Kolasch & Birch, LLP

(57) ABSTRACT

A nozzle surface cleaning apparatus is configured to clean a nozzle surface of a droplet ejection head in which the nozzle surface is inclined with respect to a horizontal plane. The nozzle surface cleaning apparatus includes: a cleaning liquid deposition device which deposits cleaning liquid on the nozzle surface while moving relatively to the nozzle surface in a direction perpendicular to a direction of inclination of the nozzle surface; and an excess cleaning liquid removal device which removes excess cleaning liquid adhering to a lower edge portion of the nozzle surface in terms of the direction of inclination, while moving relatively to the nozzle surface in the direction perpendicular to the direction of inclination of the nozzle surface, the excess cleaning liquid being a part of the cleaning liquid deposited by the cleaning liquid deposition device.

13 Claims, 22 Drawing Sheets

FIG.23

| CLEANING PATTERN | HEAD MOVEMENT SPEED | REMARKS |
|---|---|---|
| 1 | V1 | NORMAL CLEANING |
| 2 | V2 | STRONG CLEANING |

FIG.24

| CLEANING PATTERN | CLEANING LIQUID DEPOSITION HEAD | HEAD MOVEMENT SPEED | REMARKS |
|---|---|---|---|
| 1 | FIRST ONLY | V1 | NORMAL CLEANING |
| 2 | FIRST ONLY | V2 | STRONG CLEANING |
| 3 | FIRST AND SECOND | V1 | FINISHING CLEANING |
| 4 | FIRST AND SECOND | V2 | STRONG FINISHING CLEANING |

NOZZLE SURFACE CLEANING APPARATUS AND DROPLET EJECTION APPARATUS

BACKGROUND OF THE INVENTION

1. Field of the Invention

The present invention relates to a nozzle surface cleaning apparatus and a droplet ejection apparatus, and more particularly to a nozzle surface cleaning apparatus and a droplet ejection apparatus in which a droplet ejection head has a nozzle surface disposed obliquely with respect to the horizontal plane and the oblique nozzle surface is cleaned.

2. Description of the Related Art

When a recording operation is carried out continuously in an inkjet recording apparatus, ink adheres and accumulates in the vicinity of the nozzles and blockages occur in the nozzles. Hence, in an inkjet recording apparatus, cleaning of the nozzle surface is carried out periodically.

For example, Japanese Patent Application Publication Nos. 03-262646 and 2006-205712 disclose that the cleaning of the nozzle surface is performed by wiping the nozzle surface with a blade or an ink absorbing body.

Japanese Patent Application Publication No. 2002-019132 discloses that a cleaning liquid is applied to the nozzle surface before wiping in order to further increase the cleaning effect.

In an inkjet recording apparatus which performs color recording using a plurality of line heads while conveying a medium on a drum, if the heads of the respective colors (for example, yellow, cyan, magenta, black) are arranged about one drum, then it is necessary to obliquely dispose the respective heads about the periphery of the drum in such a manner that nozzle surfaces of the heads are oblique to the horizontal plane.

On the other hand, if cleaning is performed by applying cleaning liquid on the nozzle surfaces in the inkjet recording apparatus in which the nozzle surfaces are obliquely disposed, then a problem arises in that the applied cleaning liquid collects on the lower edges of the nozzle surfaces in the direction of inclination and irregularly drops down, causing soiling of the peripheral area.

Furthermore, in the case of a cleaning apparatus having a composition which subsequently performs wiping with an ink absorbing body, there is also a problem in that the cleaning liquid which has collected on the lower edges of the nozzle surfaces is absorbed by the ink absorbing body, the absorbing capacity of the ink absorbing body declines and wiping residue occurs.

SUMMARY OF THE INVENTION

The present invention has been contrived in view of these circumstances, an object thereof being to provide a nozzle surface cleaning apparatus and a droplet ejection apparatus whereby a nozzle surface can be cleaned reliably without soiling the periphery.

In order to attain the aforementioned object, the present invention is directed to a nozzle surface cleaning apparatus configured to clean a nozzle surface of a droplet ejection head in which the nozzle surface is inclined with respect to a horizontal plane, the apparatus comprising: a cleaning liquid deposition device which deposits cleaning liquid on the nozzle surface while moving relatively to the nozzle surface in a direction perpendicular to a direction of inclination of the nozzle surface; and an excess cleaning liquid removal device which removes excess cleaning liquid adhering to a lower edge portion of the nozzle surface in terms of the direction of inclination, while moving relatively to the nozzle surface in the direction perpendicular to the direction of inclination of the nozzle surface, the excess cleaning liquid being a part of the cleaning liquid deposited by the cleaning liquid deposition device.

According to this aspect of the present invention, the excess cleaning liquid removal device removes the excess cleaning liquid adhering to the lower edge portion of the nozzle surface in terms of the direction of inclination of the nozzle surface after the cleaning liquid is deposited. Thus, it is possible to prevent the cleaning liquid that has been deposited on the nozzle surface from dropping down from the lower edge portion of the nozzle surface in the direction of inclination and soiling the peripheral area.

Preferably, the excess cleaning liquid removal device includes a squeegee which is pressed against the lower edge portion of the nozzle surface to sweep the excess cleaning liquid.

According to this aspect of the present invention, the excess cleaning liquid adhering to the lower edge portion of the nozzle surface is removed by sweeping the excess liquid with the squeegee which is pressed against the lower edge portion of the nozzle surface. Thus, it is possible to remove the excess cleaning liquid by means of a simple composition.

Preferably, the cleaning liquid deposition device includes a cleaning liquid tray which receives the cleaning liquid falling down from the nozzle surface; and the excess cleaning liquid removal device sweeps the excess cleaning liquid into the cleaning liquid tray.

According to this aspect of the present invention, the cleaning liquid tray which receives the cleaning liquid falling down from the nozzle surface is arranged in the cleaning liquid deposition device, and the excess cleaning liquid is swept into the cleaning liquid tray. Thus, it is possible to recover the excess cleaning liquid together with the cleaning liquid which falls down naturally from the nozzle surface.

Preferably, the excess cleaning liquid removal device includes a suction device which suctions the excess cleaning liquid adhering to the lower edge portion of the nozzle surface.

According to this aspect of the present invention, the excess cleaning liquid adhering to the lower edge portion of the nozzle surface is removed by suctioning. Thus, the excess cleaning liquid can be removed and recovered simultaneously.

Preferably, the nozzle surface cleaning apparatus further comprises a wiping device which wipes the nozzle surface after the excess cleaning liquid is removed, while moving relatively to the nozzle surface in the direction perpendicular to the direction of inclination of the nozzle surface.

According to this aspect of the present invention, the nozzle surface is wiped with the wiping device after the excess cleaning liquid is removed. Since the nozzle surface is wiped after the excess cleaning liquid is removed, then it is possible to wipe the nozzle surface without giving rise to wiping residue.

Preferably, the nozzle surface cleaning apparatus further comprises a cleaning liquid type switching device which switches types of the cleaning liquid to be deposited on the nozzle surface from the cleaning liquid deposition device.

According to this aspect of the present invention, it is possible to switch the types of the cleaning liquid deposited onto the nozzle surface. By this means, for example, it is possible to clean using a cleaning liquid which corresponds to the extent of soiling of the nozzle surface, and the nozzle surface can be cleaned with good efficiency.

Preferably, the cleaning liquid deposition device includes a plurality of cleaning liquid deposition units which deposit the cleaning liquid on the nozzle surface and are aligned in the direction perpendicular to the direction of inclination of the nozzle surface; and the nozzle surface cleaning apparatus further comprises a cleaning liquid deposition control device which controls deposition of the cleaning liquid onto the nozzle surface by individually controlling the cleaning liquid deposition units.

According to this aspect of the present invention, the plurality of cleaning liquid deposition units are arranged in the direction perpendicular to the direction of inclination of the nozzle surface. By this means, for example, it is possible to increase the number of cleaning liquid deposition units used in accordance with the extent of soiling of the nozzle surface, and the nozzle surface can be cleaned with good efficiency.

Preferably, the cleaning liquid deposition units respectively deposit the cleaning liquid of different types onto the nozzle surface.

According to this aspect of the present invention, the cleaning liquid of different types are deposited onto the nozzle surface from the respective cleaning liquid deposition units. By this means, for example, it is possible to clean using a cleaning liquid which corresponds to the extent of soiling of the nozzle surface, and the nozzle surface can be cleaned with good efficiency.

Preferably, the nozzle surface cleaning apparatus further comprises a movement control device which controls and changes a speed of relative movement of the cleaning liquid deposition device and the excess cleaning liquid removal device with respect to the nozzle surface.

According to this aspect of the present invention, it is possible to change the speed of relative movement of the cleaning liquid deposition device and the excess cleaning liquid removal device with respect to the nozzle surface. By this means, for example, it is possible to change the speed of relative movement in accordance with the extent of soiling of the nozzle surface, and the nozzle surface can be cleaned with good efficiency.

In order to attain the aforementioned object, the present invention is also directed to a droplet ejection apparatus, comprising: a droplet ejection head in which a nozzle surface is inclined with respect to the horizontal plane; and the above-described nozzle surface cleaning apparatus which cleans the nozzle surface of the droplet ejection head.

According to this aspect of the present invention, the nozzle surface cleaning apparatus is incorporated in the droplet ejection apparatus in which the nozzle surface of the droplet ejection head is inclined with respect to the horizontal plane.

Preferably, the droplet ejection head includes a line head having a length corresponding to a width of a medium; and the nozzle surface is inclined in a direction perpendicular to a lengthwise direction of the line head.

According to this aspect of the present invention, the droplet ejection head includes the line head having the length corresponding to the width of the medium, and the nozzle surface is inclined in the direction perpendicular to the lengthwise of the line head.

Preferably, the droplet ejection apparatus further comprises: a conveyance drum which conveys the medium while holding the medium on a circumferential surface thereof, wherein the nozzle surface is inclined to face the circumferential surface of the conveyance drum.

According to this aspect of the present invention, the nozzle surface is inclined so as to face the circumferential surface of the conveyance drum which conveys the medium.

According to the present invention, it is possible to reduce the replacement frequency of the wiping member. Furthermore, it is possible to make the overall composition of the inkjet recording apparatus more compact in size.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 23 is a table showing cleaning patterns implemented by a controller in the nozzle surface cleaning apparatus having one cleaning liquid deposition head; and FIG. 24 is a table showing cleaning patterns implemented by a controller in the nozzle surface cleaning apparatus having two cleaning liquid deposition heads.

DETAILED DESCRIPTION OF THE PREFERRED EMBODIMENTS

Here, an example is described in which a nozzle surface cleaning apparatus according to an embodiment of the present invention is incorporated in an inkjet recording apparatus which records an image on a cut sheet of paper.

Composition of Image Recording Unit of Inkjet Recording Apparatus

Figure 1:
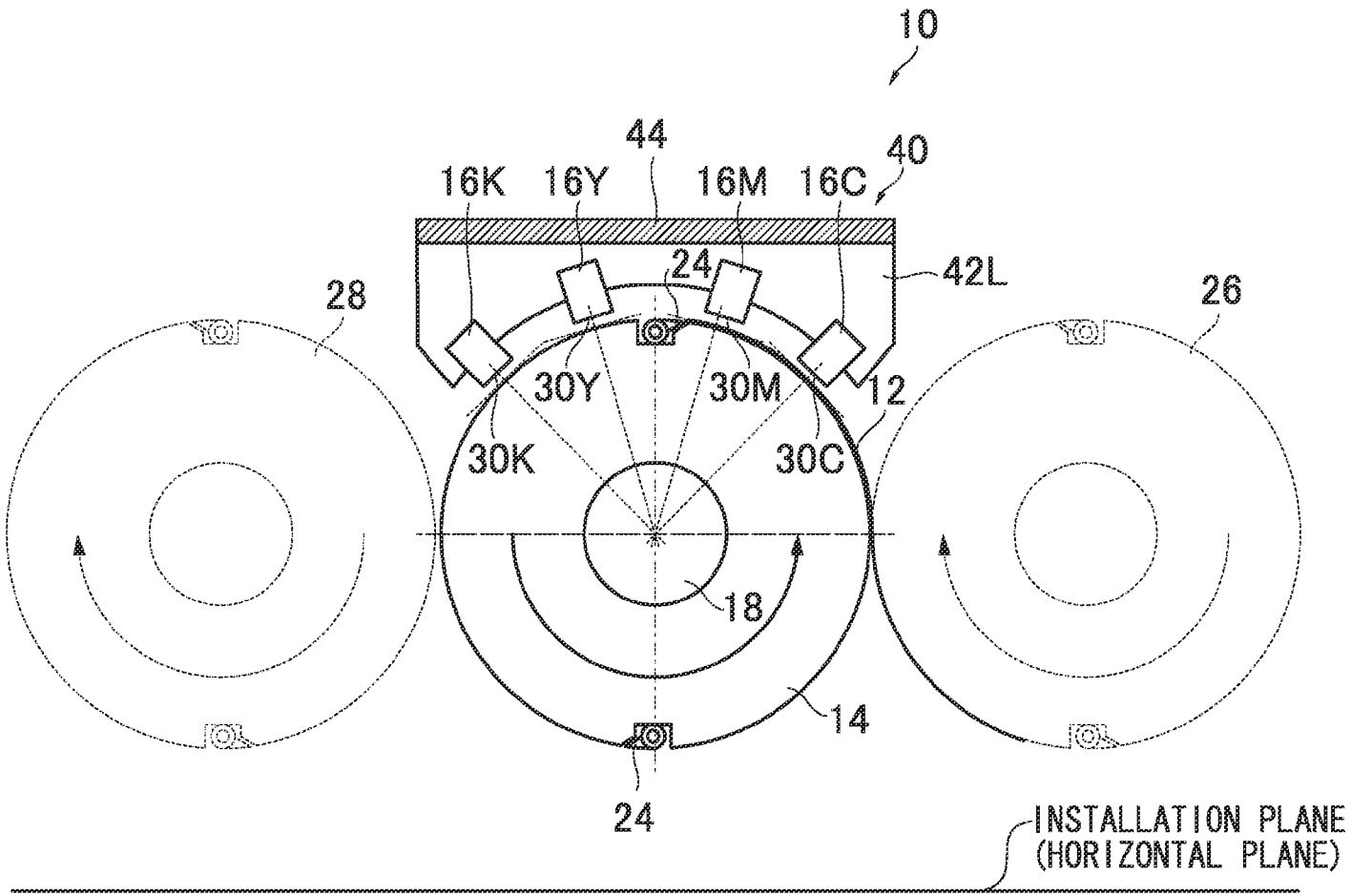
FIG. 1 is a side view diagram showing the general composition of an image recording unit of an inkjet recording apparatus.

FIG. 1 is a side view diagram showing the general composition of an image recording unit of an inkjet recording apparatus.

As shown in FIG. 1, the image recording unit 10 of the inkjet recording apparatus according to the present embodiment conveys a medium (cut sheet of paper) 12 by means of an image recording drum 14. Droplets of inks of respective colors of cyan (C), magenta (M), yellow (Y), black (K) are ejected and deposited on a surface of the medium 12 from inkjet heads (droplet ejection heads) 16C, 16M, 16Y and 16K, which are arranged about the periphery of the image recording drum 14, whereby a color image is recorded on the surface of the medium 12.

Figure 2:
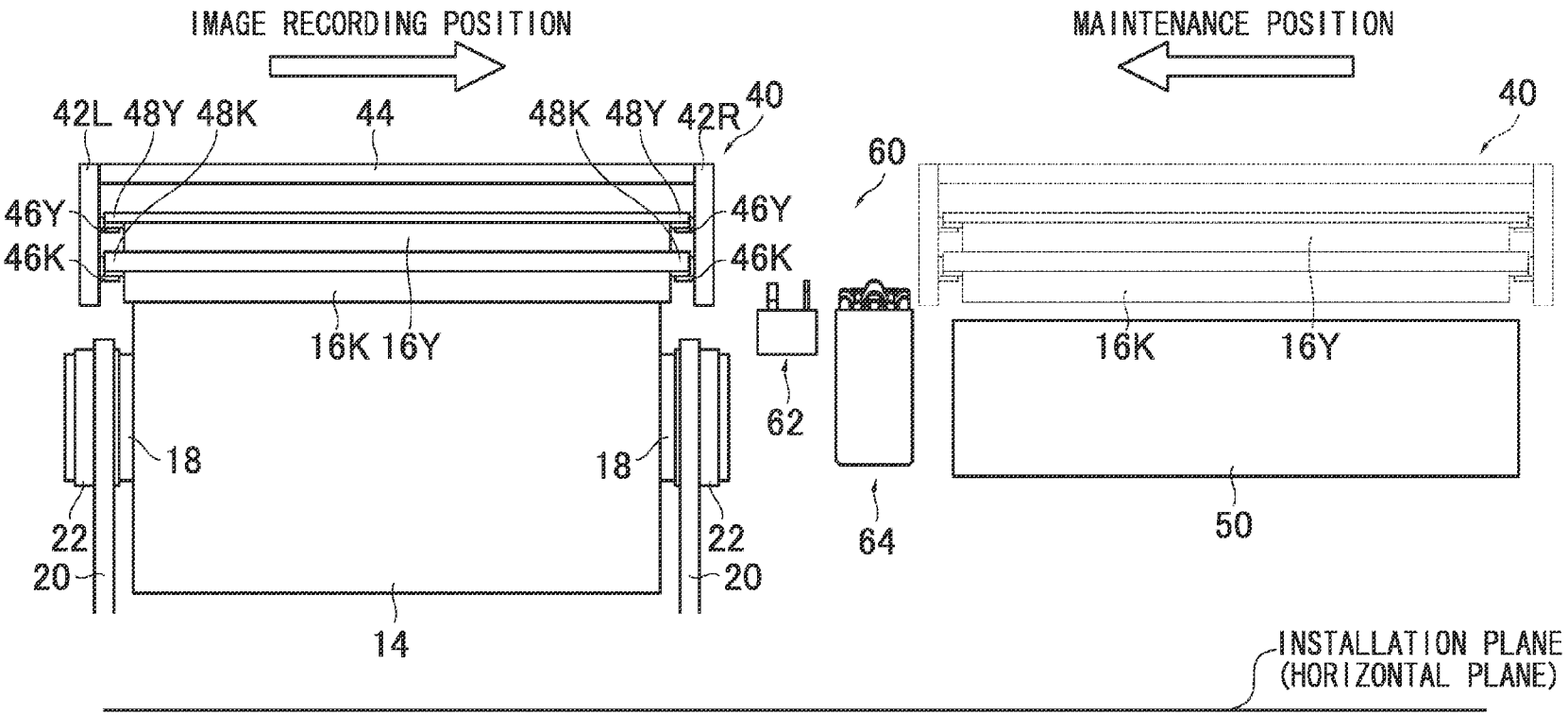
FIG. 2 is a front view diagram of the image recording unit of the inkjet recording apparatus.

The image recording drum 14 is arranged rotatably, and end portions of a rotating shaft 18 of the image recording drum 14 are supported on a pair of bearings 22 (see FIG. 2). The bearings 22 are arranged on a main frame 20 of the inkjet recording apparatus, and due to the end portions of the rotating shaft 18 being supported on this pair of bearings 22, the image recording drum 14 is installed horizontally (the rotating shaft 18 is installed in parallel with the horizontal installation surface).

A motor is coupled to the rotating shaft 18 of the image recording drum 14 through a rotation transmission mechanism (not illustrated). The image recording drum 14 is driven by the motor to rotate.

The image recording drum 14 is provided with grippers 24 arranged on the circumferential surface thereof (in the present embodiment, at two locations on the outer circumferential surface thereof) so as to grip a leading end portion of the medium 12. The leading end portion of the medium 12 is gripped by the grippers 24 and thereby held on the outer circumferential surface of the image recording drum 14.

The image recording drum 14 is further provided with an attraction holding mechanism which is not illustrated (for example, an electrostatic attraction mechanism or a vacuum suction mechanism). The medium 12 which is wrapped about the outer circumferential surface of the image recording drum 14 and the leading end portion of which is gripped by the gripper 24 is held by attraction on the rear surface side thereof by the attraction holding mechanism and thereby held on the outer circumferential surface of the image recording drum 14.

In the inkjet recording apparatus according to the present embodiment, the medium 12 is transferred to the image recording drum 14 through a conveyance drum 26 from a previous step. The conveyance drum 26 is disposed in parallel with the image recording drum 14 and transfers the medium 12 onto the image recording drum 14 in a synchronized fashion.

Furthermore, the medium 12 after the image recording is transferred to a subsequent step through a conveyance drum 28. The conveyance drum 28 is disposed in parallel with the image recording drum 14 and receives the medium 12 from the image recording drum 14 in a synchronized fashion.

The four inkjet heads 16C, 16M, 16Y and 16K are constituted of line heads having widths corresponding to the width of the medium, and are arranged at uniform intervals apart radially on a circle concentric with the rotating shaft 18 of the image recording drum 14.

In the present embodiment, the four inkjet heads 16C, 16M, 16Y and 16K are arranged horizontally symmetrically about the image recording drum 14. In other words, the cyan inkjet head 16C and the black inkjet head 16K are disposed symmetrically with respect to the vertical line that passes through the center of the image recording drum 14, and the magenta inkjet head 16M and the yellow inkjet head 16Y are also disposed horizontally symmetrically with respect to the same vertical line.

Nozzle surfaces 30C, 30M, 30Y and 30K, which are formed at lower ends of the inkjet heads 16C, 16M, 16Y and 16K disposed as described above, are positioned so as to face the outer circumferential surface of the image recording drum 14, and the nozzle surfaces 30C, 30M, 30Y and 30K are disposed at a prescribed height position from the outer circumferential surface of the image recording drum 14 (a uniform gap is formed between the outer circumferential surface of the image recording drum 14 and each of the nozzle surfaces 30C, 30M, 30Y and 30K). Furthermore, inkjet nozzles are formed in the nozzle surfaces 30C, 30M, 30Y and 30K, and are arranged in rows perpendicular to the conveyance direction of the medium 12.

Ink droplets are ejected perpendicularly toward the outer circumferential surface of the image recording drum 14 from the nozzles which are formed on the nozzle surfaces 30C, 30M, 30Y and 30K of the inkjet heads 16C, 16M, 16Y, 16K disposed as described above.

Figure 3:
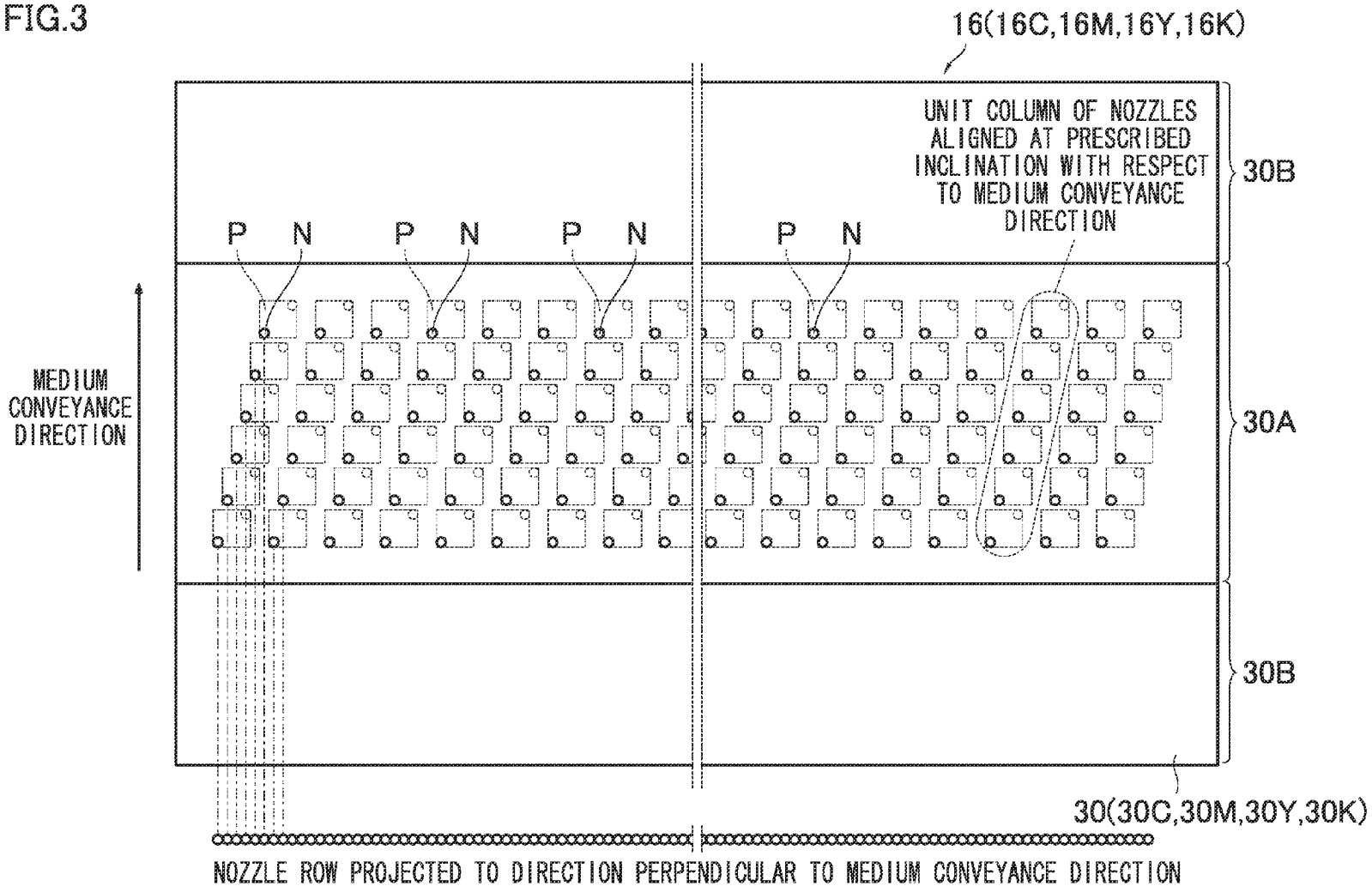
FIG. 3 is a plan view perspective diagram of a nozzle surface of an inkjet head.

FIG. 3 is a plan view perspective diagram of the nozzle surface of the inkjet head.

The nozzle surfaces have the same composition and therefore the composition of one nozzle surface 30 is described here.

As shown in FIG. 3, the nozzle surface 30 (30C, 30M, 30Y, 30K) is formed in a rectangular shape and is constituted of a nozzle forming surface 30A, in which nozzles N are formed, and nozzle protection surfaces 30B, which protect the nozzle forming surface 30A.

The nozzle forming surface 30A is disposed in the center of the nozzle surface 30 and a prescribed liquid repelling treatment is applied to the nozzle forming surface 30A. The inkjet recording apparatus according to the present embodiment has a composition in which the nozzles N are arranged in a two-dimensional matrix configuration in the nozzle forming surface 30A. More specifically, the nozzle rows are formed by arranging the nozzles N at a uniform pitch in a direction inclined by a prescribed angle with respect to the direction of conveyance of the medium 12, and furthermore a plurality of the nozzle rows are arranged at uniform pitch in the direction perpendicular to the conveyance direction of the medium 12. By adopting this arrangement for the nozzles, it is possible to reduce the effective pitch between the nozzles N as projected to the lengthwise direction of the head (namely, a direction perpendicular to the conveyance direction of the medium 12), and therefore a high-density configuration of the nozzles N can be achieved.

The nozzle protection surfaces 30B are arranged on either side of the nozzle forming surface 30A. The nozzle protection surfaces 30B are formed to project by a prescribed amount from the nozzle forming surface 30A.

The nozzles N formed in the nozzle surface 30 are connected respectively to pressure chambers P, and droplets of ink are ejected from the nozzles N by expanding and contracting the volume of the pressure chambers P by means of actuators, such as piezoelectric elements.

The image recording unit 10 has the composition described above. In the image recording unit 10, the medium 12 is received onto the image recording drum 14 from the previous step through the conveyance drum 26, and is conveyed in rotation while being held by attraction on the circumferential surface of the image recording drum 14. The medium 12 passes below the inkjet heads 16C, 16M, 16Y and 16K during this conveyance and ink droplets are ejected and deposited from the inkjet heads 16C, 16M, 16Y and 16K onto the recording surface of the medium 12 as the medium 12 passes, thereby forming a color image on the recording surface of the medium 12. After having completed the image recording, the medium 12 is transferred from the image recording drum 14 to the conveyance drum 28 and is conveyed to the subsequent step.

In the image recording unit 10 having the composition described above, the inkjet heads 16C, 16M, 16Y and 16K are installed on a head supporting frame 40 and are arranged around the image recording drum 14 as shown in FIG. 2.

The head supporting frame 40 is constituted of a pair of side plates 42L and 42R, which are arranged perpendicularly to the rotating shaft 18 of the image recording drum 14, and a linking frame 44, which links the pair of side plate 42L and 42R together at the upper end portions thereof.

Each of the side plates 42L and 42R is formed in a plate shape, and the side plates 42L and 42R are disposed so as to face each other across the image recording drum 14. Installation sections 46C, 46M, 46Y and 46K for installing the respective inkjet heads 16C, 16M, 16Y and 16K are provided on the inner side faces of the pair of side plates 42L and 42R (only the installation sections 46Y and 46K are depicted in FIG. 2).

The installation sections 46C, 46M, 46Y and 46K are disposed at a uniform spacing apart radially on a circle concentric with the rotating shaft 18 of the image formation drum 14. The inkjet heads 16C, 16M, 16Y and 16K are installed on the head supporting frame 40 by fixing attachment sections 48C, 48M, 48Y and 48K, which are formed on the respective ends of the heads (only the attachment sections 48Y and 48K are depicted in FIG. 2) onto the installation sections 46C, 46M, 46Y and 46K. By installing the inkjet heads 16C, 16M, 16Y and 16K on the head supporting frame 40, the inkjet heads 16C, 16M, 16Y and 16K are disposed at uniform intervals apart radially on a circle concentric with the rotating shaft 18 of the image formation drum 14.

The head supporting frame 40 for installing the inkjet heads 16C, 16M, 16Y and 16K is arranged slidably in a direction parallel to the rotating shaft 18 of the image formation drum 14 by being guided by guide rails (not illustrated). The head supporting frame 40 is arranged movably between an "image recording position" indicated by the solid lines in FIG. 2 and a "maintenance position" indicated by the dotted lines in FIG. 2, by being driven by a linear drive mechanism (not illustrated) such as, for example, a screw feed mechanism.

When the head supporting frame 40 is disposed in the image recording position, the inkjet heads 16C, 16M, 16Y and 16K are disposed about the periphery of the image recording drum 14 and assume a state capable of image recording.

On the other hand, when the head supporting frame 40 is disposed in the maintenance position, the inkjet heads 16C, 16M, 16Y and 16K are retracted from the image recording drum 14. A moisturizing unit 50 for moisturizing the inkjet heads 16C, 16M, 16Y and 16K is provided in this maintenance position. When the inkjet heads 16C, 16M, 16Y and 16K are not used for a long time, the head supporting frame 40 is placed in the maintenance position and the inkjet heads 16C, 16M, 16Y and 16K are moisturized by the moisturizing unit 50. Thereby, ejection failure due to drying is prevented.

The movement of the head supporting frame 40 is controlled by a controller (not shown). This controller is a control unit which performs overall control of the operation of the whole inkjet recording apparatus, and controls the movement of the head supporting frame 40 by controlling the driving of the linear drive mechanism.

A nozzle surface cleaning apparatus 60 for cleaning the nozzle surfaces 30C, 30M, 30Y and 30K of the inkjet heads 16C, 16M, 16Y and 16K is arranged between the image recording position and the maintenance position. When the inkjet heads 16C, 16M, 16Y and 16K are moved from the image recording position to the maintenance position, cleaning liquid is deposited onto the nozzle surfaces 30C, 30M, 30Y and 30K from the nozzle surface cleaning apparatus 60, and the nozzle surfaces 30C, 30M, 30Y and 30K are wiped with wiping webs and cleaned.

Below, the composition of the nozzle surface cleaning apparatus 60 is described.

Composition of Nozzle Surface Cleaning Apparatus

First Embodiment

As shown in FIG. 2, the nozzle surface cleaning apparatus 60 includes: a cleaning liquid deposition device 62, which deposits the cleaning liquid onto the nozzle surfaces 30C, 30M, 30Y and 30K of the inkjet heads 16C, 16M, 16Y and 16K; and a wiping device 64, which wipes the nozzle surface 30C, 30M, 30Y and 30K of the inkjet heads 16C, 16M, 16Y and 16K on which the cleaning liquid has been deposited.

The cleaning liquid deposition device 62 and the wiping device 64 are arranged on a movement path of the head supporting frame 40, and the cleaning liquid deposition device 62 is arranged to the image recording drum 14 side of the wiping device 64. In other words, the cleaning liquid deposition device 62 is arranged on the upstream side of the wiping device 64 in terms of the direction of movement of the head supporting frame 40 from the image recording position toward the maintenance position.

<Composition of Cleaning Liquid Deposition Device>

Figure 4:
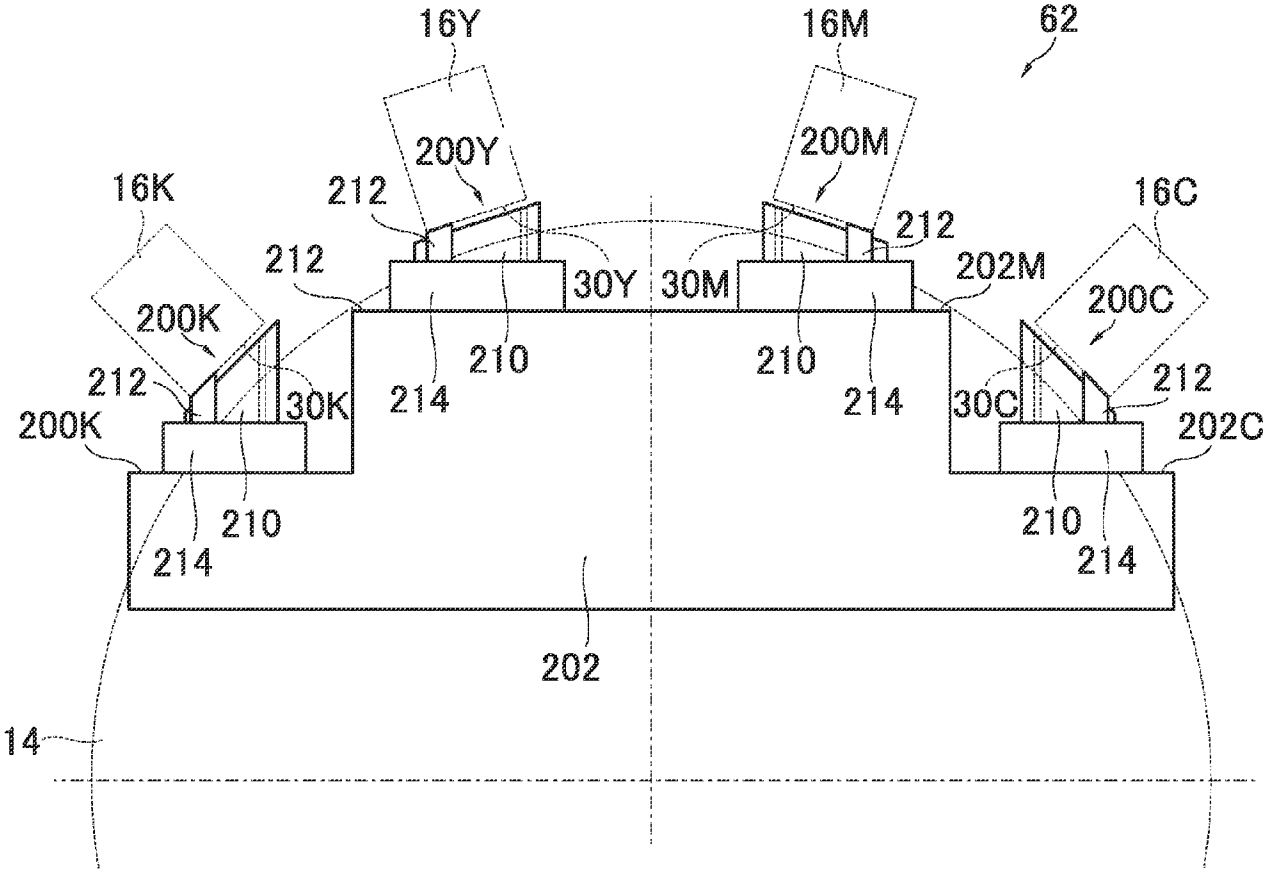
FIG. 4 is a side view diagram showing a cleaning liquid deposition device viewed from the maintenance position side.

FIG. 4 is a side view diagram showing the cleaning liquid deposition device 62 viewed from the maintenance position side.

The cleaning liquid deposition device 62 is constituted of cleaning liquid deposition units 200C, 200M, 200Y and 200K, which are arranged correspondingly to the inkjet heads 16C, 16M, 16Y and 16K, and a base 202, on which the cleaning liquid deposition unit 200C, 200M, 200Y and 200K are mounted.

<<Composition of Base>>

The base 202 is horizontally arranged so as to be raisable and lowerable by an elevator device (not shown). Cleaning liquid deposition unit attachment sections 202C, 202M, 202Y and 202K are formed in the upper surface portion of the base 202. The cleaning liquid deposition units 200C, 200M, 200Y and 200K are fixed to the cleaning liquid deposition unit attachment sections 202C, 202M, 202Y and 202K formed on the base 202, by bolts, or the like, and are thereby installed in prescribed positions. By installing the cleaning liquid deposition units 200C, 200M, 200Y and 200K on the base 202, the cleaning liquid deposition units 200C, 200M, 200Y and 200K are arranged over the movement path of the corresponding inkjet heads 16C, 16M, 16Y and 16K (namely, over the movement path from the image recording position to the maintenance position).

<<Composition of Cleaning Liquid Deposition Unit>>

Next, the composition of the cleaning liquid deposition units 200C, 200M, 200Y and 200K is described.

The cleaning liquid deposition units 200C, 200M, 200Y and 200K each have the same basic composition and therefore the composition of a cleaning liquid deposition unit 200 is described here.

Figure 5:
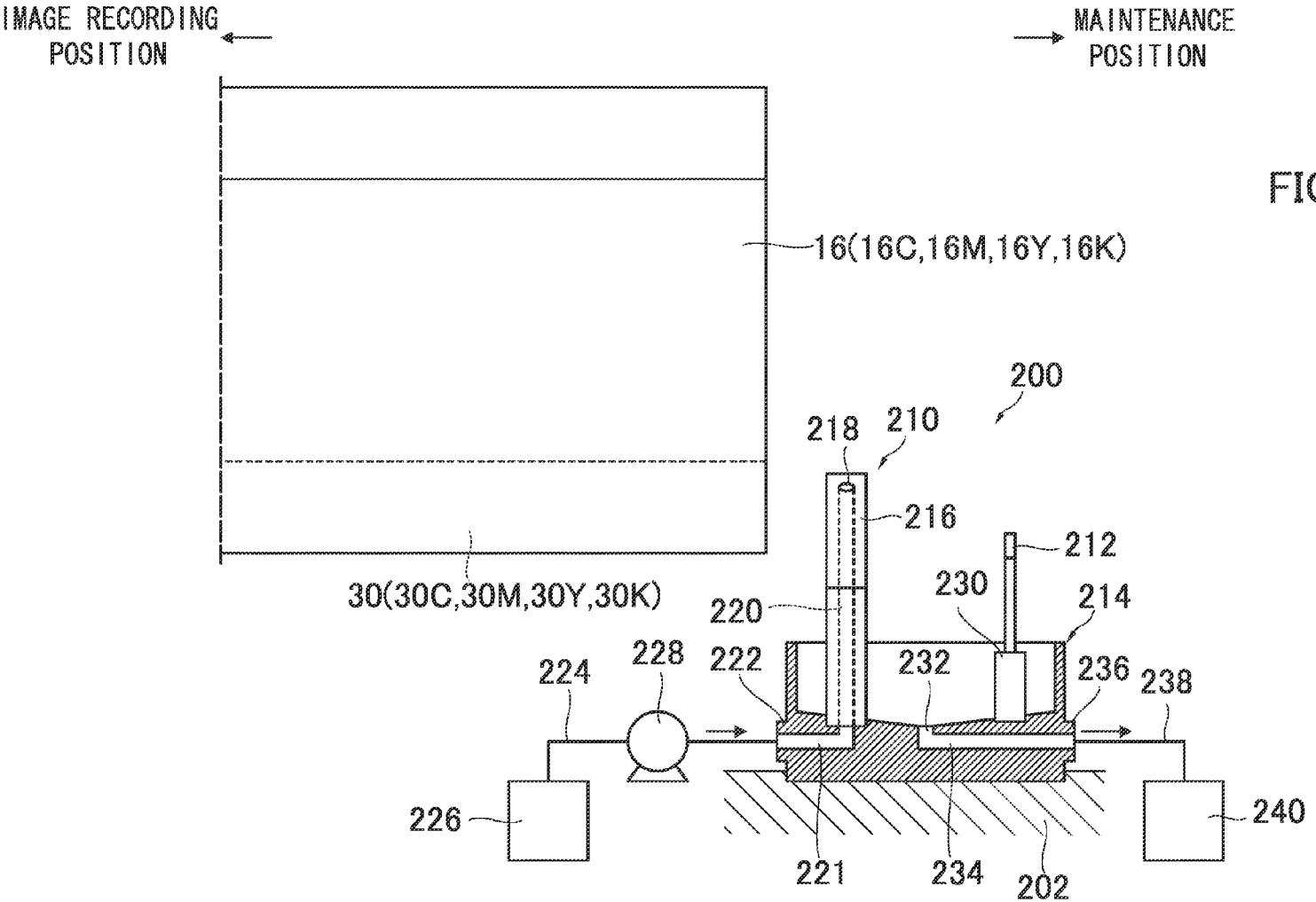
FIG. 5 is a front view diagram of a cleaning liquid deposition unit.
Figure 6:
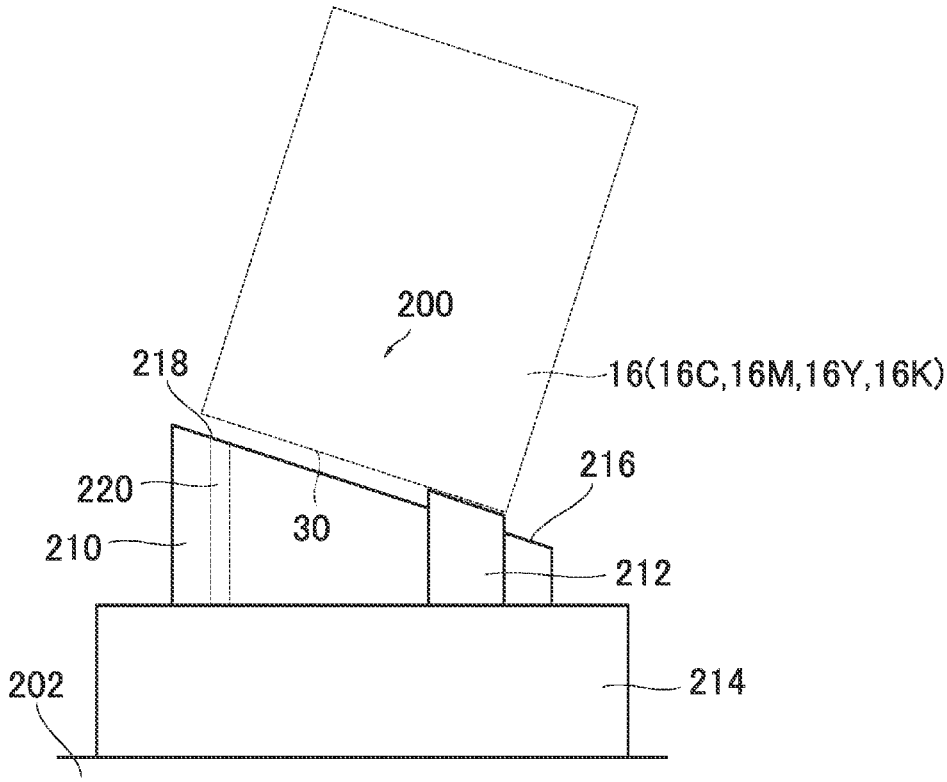
FIG. 6 is a side view diagram showing the cleaning liquid deposition unit viewed from the maintenance position side.
Figure 7:
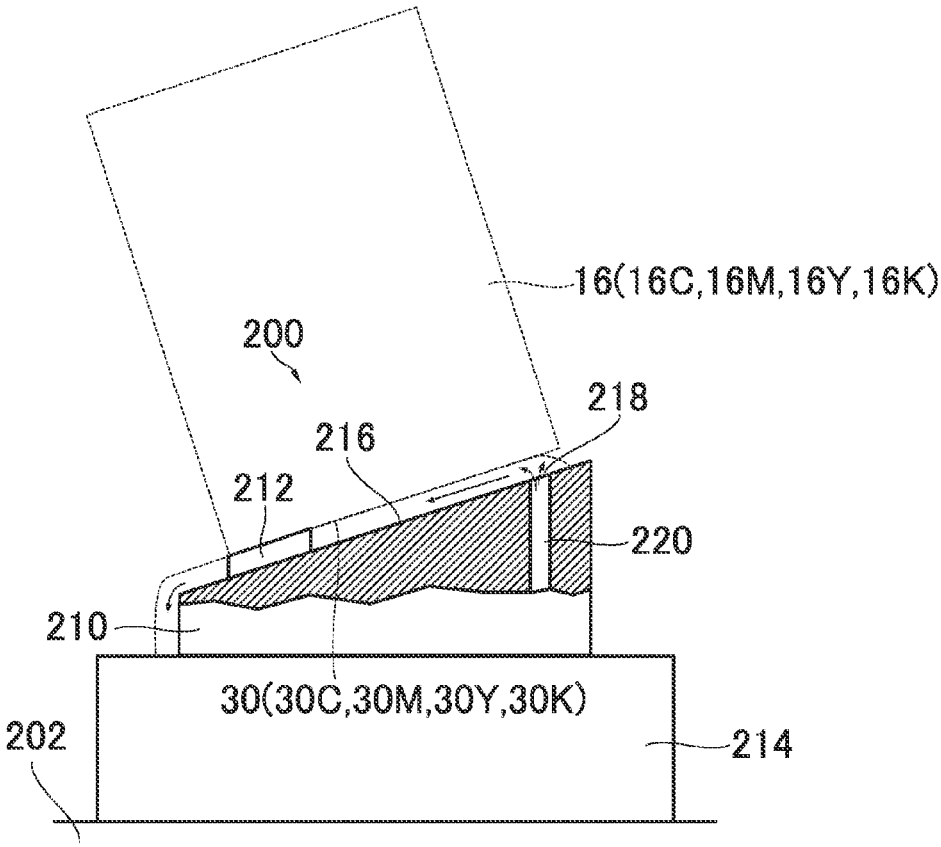
FIG. 7 is a side view diagram showing the cleaning liquid deposition unit viewed from the image recording position side.

FIG. 5 is a front view diagram of the cleaning liquid deposition unit 200, and FIGS. 6 and 7 are side view diagrams of the cleaning liquid deposition unit 200, observed from the maintenance position side and the image recording position side, respectively.

As shown in FIGS. 5 to 7, the cleaning liquid deposition unit 200 includes: a cleaning liquid deposition head 210, which deposits the cleaning liquid onto the nozzle surface 30; a squeegee 212, which sweeps, from the nozzle surface 30, excess cleaning liquid which has collected on the lower edge of the nozzle surface 30 in the direction of inclination; and a cleaning liquid recovery tray 214, which recovers the cleaning liquid falling down from the nozzle surface 30.

The cleaning liquid recovery tray 214 is formed in the shape of a rectangular box of which the upper portion is open. The cleaning liquid deposition head 210 and the squeegee 212 are arranged inside the cleaning liquid recovery tray 214.

The cleaning liquid deposition head 210 is formed in a rectangular block shape with an inclined upper surface, and has a cleaning liquid holding surface 216, which is parallel to the nozzle surface 30, on the upper portion thereof. The cleaning liquid holding surface 216 is formed at the same angle of inclination of the nozzle surface 30 of the head that is to be cleaned, and is formed to a slightly greater width than the width of the nozzle surface 30 (the width in the medium conveyance direction).

A cleaning liquid emission port 218 is formed in the vicinity of the upper part of the cleaning liquid holding surface 216, and the cleaning liquid flows out from the cleaning liquid emission port 218. The cleaning liquid which has flowed out from the cleaning liquid emission port 218 flows down the inclined cleaning liquid holding surface 216 and is recovered in the cleaning liquid recovery tray 214. By setting the gap between the cleaning liquid holding surface 216 and the nozzle surface 30 to a uniform value, when the nozzle surface 30 passes over the cleaning liquid holding surface 216, the cleaning liquid which has flowed down over the cleaning liquid holding surface 216 makes contact with the nozzle surface 30 and the cleaning liquid is thereby deposited on the nozzle surface 30.

A cleaning liquid supply flow channel 220 connected to the cleaning liquid emission port 218 is formed inside the cleaning liquid deposition head 210. The cleaning liquid supply flow channel 220 is connected to a connection flow channel 221 formed in the cleaning liquid recovery tray 214. A cleaning liquid supply port 222 connected to the connection flow channel 221 is formed in the cleaning liquid recovery tray 214, and the cleaning liquid flows out from the cleaning liquid emission port 218 due to the cleaning liquid being supplied to the cleaning liquid supply port 222.

The cleaning liquid supply port 222 is connected to a cleaning liquid supply tank 226 through a cleaning liquid supply channel 224. A cleaning liquid supply pump 228 is arranged at an intermediate position of the cleaning liquid supply channel 224, and by driving the cleaning liquid supply pump 228, the cleaning liquid is supplied from the cleaning liquid supply tank 226 to the cleaning liquid supply port 222.

The squeegee 212 is formed in a plate shape of a material having elastic properties, such as silicone rubber, EPDM (ethylene propylene dyne monomer rubber), NBR (nitriles butadiene rubber), urethane, or the like. A squeegee installation section 230 for installing the squeegee 212 is arranged inside the cleaning liquid recovery tray 214. The squeegee installation section 230 is arranged on the maintenance position side with respect to the cleaning liquid deposition head 210. The squeegee 212 is installed vertically on the squeegee installation section 230. The squeegee 212 installed on the squeegee installation section 230 is arranged perpendicularly with respect to the lengthwise direction of the nozzle surface 30.

The tip portion of the squeegee 212 is formed at an inclination correspondingly to the nozzle surface 30 of the head that is to be cleaned (namely, is formed at an angle of inclination which is the same as the angle of inclination of the nozzle surface to be cleaned).

When the nozzle surface 30 passes the squeegee 212, the tip portion of the squeegee 212 abuts and presses against the lower edge portion of the nozzle surface 30 in the direction of inclination. Thereby, it is possible to sweep excess cleaning liquid which has collected on the lower edge portion of the nozzle surface 30 in the direction of inclination, by means of the squeegee 212.

The excess cleaning liquid swept with the squeegee 212 drops down under its own weight and is recovered in the cleaning liquid recovery tray 214.

The cleaning liquid recovery tray 214 is formed in the shape of the rectangular box, the upper portion of which is open, as described above. The bottom face of the interior of the cleaning liquid recovery tray 214 is formed at an inclination to the center. A cleaning liquid recovery hole 232 is formed in the central portion of the bottom face of the cleaning liquid recovery tray 214. A cleaning liquid discharge port 236 connected to the cleaning liquid recovery hole 232 through a cleaning liquid recovery flow channel 234 is formed in the side face portion of the cleaning liquid recovery tray 214.

The cleaning liquid discharge port 236 is connected to a cleaning liquid recovery tank 240 through a cleaning liquid recovery channel 238. The cleaning liquid recovered by the cleaning liquid recovery tray 214 is recovered into the cleaning liquid recovery tank 240.

Each of the cleaning liquid deposition units 200 (200C, 200M, 200Y, 200K) is composed as described above. The cleaning liquid deposition device 62 is composed by installing the cleaning liquid deposition units 200C, 200M, 200Y and 200K on the cleaning liquid deposition unit installation sections 202C, 202M, 202Y and 202K formed in the base 202.

The operation of the cleaning liquid deposition device 62 is controlled by a controller, which is not illustrated. The controller controls the cleaning liquid deposition operation by the cleaning liquid deposition device 62 by controlling the driving of the elevator device, the cleaning liquid supply pump 228, and the like.

<<Action of Cleaning Liquid Deposition Device>>

Next, a cleaning liquid deposition operation by the cleaning liquid deposition device 62 according to the present embodiment having the composition described above is explained.

The cleaning liquid deposition device 62 deposits the cleaning liquid onto the nozzle surfaces 30 (30C, 30M, 30Y, 30K) of the inkjet heads 16 (16C, 16M, 16Y, 16K) while the inkjet heads 16 (16C, 16M, 16Y, 16K) move from the image recording position to the maintenance position. More specifically, the cleaning liquid is deposited as follows.

The whole of the cleaning liquid deposition device 62 is arranged raisable and lowerable. When not performing cleaning, the cleaning liquid deposition device 62 is disposed in a prescribed standby position. During cleaning, the cleaning liquid deposition device 62 is raised by a prescribed amount from the standby position to a prescribed operating position.

When the cleaning liquid deposition device 62 is moved to the operating position, the cleaning liquid deposition units 200C, 200M, 200Y and 200K are set in prescribed cleaning liquid deposition positions. Thereby, it is possible to deposit the cleaning liquid onto the nozzle surfaces 30C, 30M, 30Y and 30K of the inkjet heads 16C, 16M, 16Y and 16K, by means of the cleaning liquid deposition heads 210 arranged in the cleaning liquid deposition units 200C, 200M, 200Y and 200K, and it is also possible to sweep excess cleaning liquid which collects on the lower edge portions of the nozzle surfaces 30C, 30M, 30Y and 30K of the inkjet heads 16C, 16M, 16Y and 16K in the direction of inclination, by means of the squeegees 212 arranged on the cleaning liquid deposition units 200C, 200M, 200Y and 200K. In other words, when the cleaning liquid deposition units 200C, 200M, 200Y and 200K are set in the cleaning liquid deposition position, they are set in the positions where the cleaning liquid which has flowed over the cleaning liquid holding surfaces 216 of the cleaning liquid deposition heads 210 makes contact with the nozzle surfaces 30C, 30M, 30Y and 30K (i.e., the positions where the gaps between the cleaning liquid holding surfaces 216 and the nozzle surfaces 30C, 30M, 30Y and 30K are in a prescribed range). Furthermore, the cleaning liquid deposition units 200C, 200M, 200Y and 200K are set in the positions where the tip portions of the squeegees 212 abut and press against the lower edge portions of the nozzle surfaces 30C, 30M, 30Y and 30K in the direction of inclination.

When the cleaning liquid deposition units 200C, 200M, 200Y and 200K are set in the prescribed cleaning liquid deposition position, the controller drives the linear drive mechanism and causes the head supporting frame 40 to move at a prescribed speed of movement from the image recording position to the maintenance position.

On the other hand, the controller also drives the cleaning liquid supply pump 228 in accordance with the timing at which the inkjet heads 16C, 16M, 16Y and 16K arrive at the cleaning liquid deposition heads 210 of the cleaning liquid deposition units 200C, 200M, 200Y and 200K. Thereby, the cleaning liquid flows out at a prescribed flow rate from the cleaning liquid emission ports 218 of the cleaning liquid deposition heads 210 in the respective cleaning liquid deposition units 200C, 200M, 200Y and 200K. The cleaning liquid which has flowed out from the cleaning liquid emission ports 218 flows down over the cleaning liquid holding surfaces 216.

When the inkjet heads 16C, 16M, 16Y and 16K moving toward the maintenance position pass the cleaning liquid deposition heads 210, the cleaning liquid which has flowed over the cleaning liquid holding surfaces 216 of the cleaning liquid deposition heads 210 contacts the nozzle surfaces 30C, 30M, 30Y and 30K, and the cleaning liquid is thereby deposited on the nozzle surfaces 30C, 30M, 30Y and 30K.

In the inkjet recording apparatus according to the present embodiment, as shown in FIG. 2, the inkjet heads 16C, 16M, 16Y and 16K are arranged about the periphery of the image recording drum 14, and are obliquely disposed (i.e., the nozzle surfaces 30C, 30M, 30Y and 30K are inclined with respect to the horizontal plane). As a result of this, the cleaning liquid deposited on the nozzle surfaces 30C, 30M, 30Y and 30K is liable to collect in the lower edge portions of the nozzle surfaces 30C, 30M, 30Y and 30K in the direction of inclination.

However, in the cleaning liquid deposition device 62 according to the present embodiment, by arranging the squeegees 212 in the cleaning liquid deposition units 200C, 200M, 200Y and 200K, it is possible to remove excess liquid which collects in the lower edge portions of the nozzle surfaces 30C, 30M, 30Y and 30K in the direction of inclination.

More specifically, the nozzle surfaces 30C, 30M, 30Y and 30K on which the cleaning liquid has been deposited by the cleaning liquid deposition heads 210 pass the installation positions of the squeegees 212 after the cleaning liquid has been deposited thereon by passing the cleaning liquid deposition heads 210, and in so doing, the squeegees 212 abut and press against the lower edge portions of the nozzle surfaces 30C, 30M, 30Y and 30K in the direction of inclination. Thereby, the excess cleaning liquid which has collected on the lower edge portions in the direction of inclination is swept with the squeegees 212, and is removed from the nozzle surfaces 30C, 30M, 30Y and 30K.

Thus, by means of the cleaning liquid deposition device 62 in the present embodiment, it is possible to deposit the cleaning liquid onto the whole of the nozzle surfaces, without excess cleaning liquid collecting in the lower edge portions in the direction of inclination.

<Composition of Wiping Device>

Figure 8:
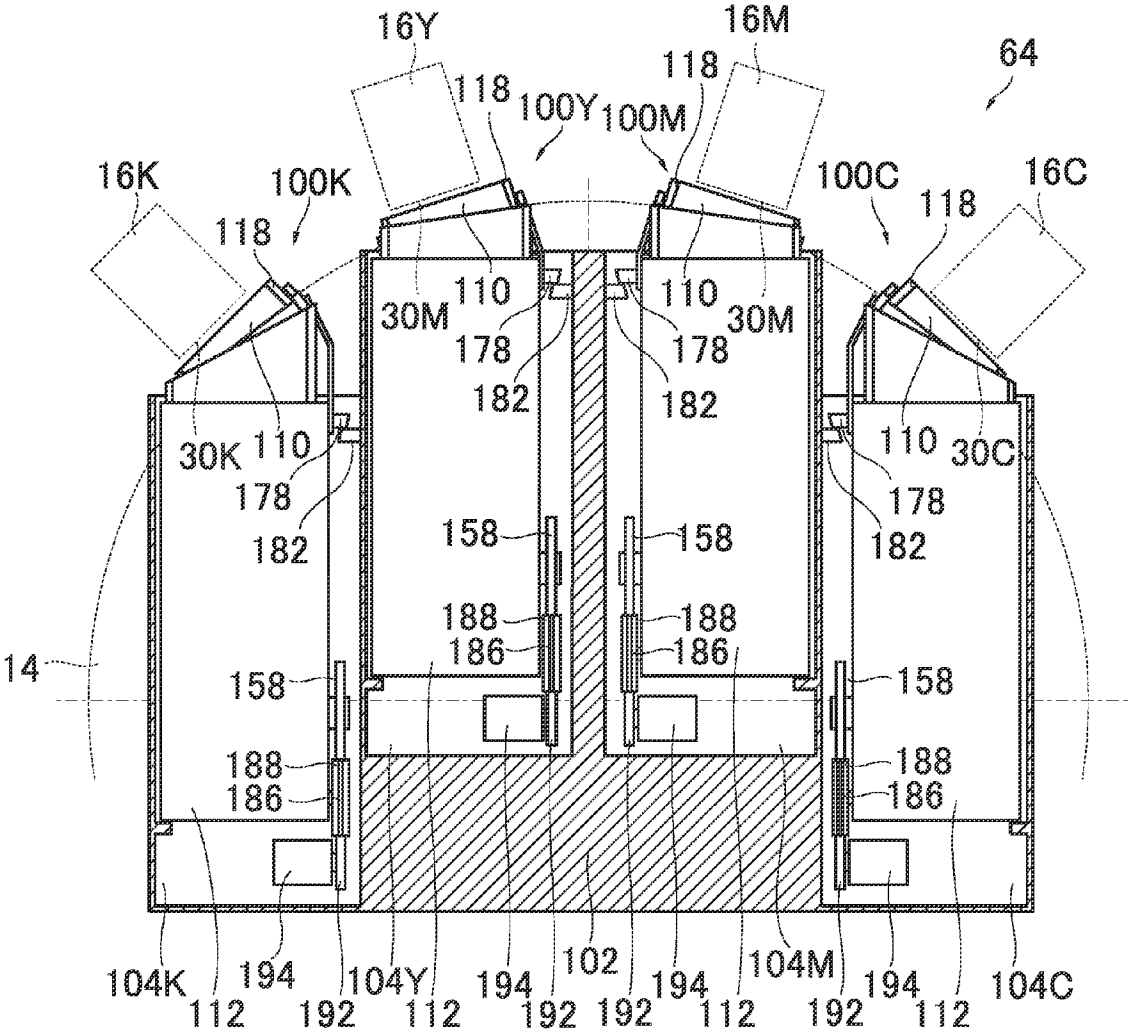
FIG. 8 is a side view diagram showing the composition of a wiping device.

FIG. 8 is a side view diagram showing the wiping device 64 viewed from the maintenance position side.

As shown in FIG. 8, the wiping device 64 includes wiping units 100C, 100M, 100Y and 100K, which are arranged correspondingly to the inkjet heads 16C, 16M, 16Y and 16K, and a rack 102, in which the wiping units 100C, 100M, 100Y and 100K are set.

<<Composition of Rack>>

The rack 102 is horizontally arranged so as to be raisable and lowerable by an elevator device (not shown). The rack 102 is formed in a box shape having an open upper end portion, and installation sections 104C, 104M, 104Y and 104K for installing the wiping units 100C, 100M, 100Y and 100K are arranged inside the rack 102. The wiping units 100C, 100M, 100Y and 100K are set in the respective installation sections 104C, 104M, 104Y and 104K by being inserted vertically downward through the upper end openings of the installation sections 104C, 104M, 104Y and 104K.

<<Composition of Wiping Unit>>

Next, the composition of the wiping units 100C, 100M, 100Y and 100K is described.

The wiping units 100C, 100M, 100Y and 100K all have the same basic composition and therefore the composition is described here with respect to one wiping unit 100.

Figure 9:
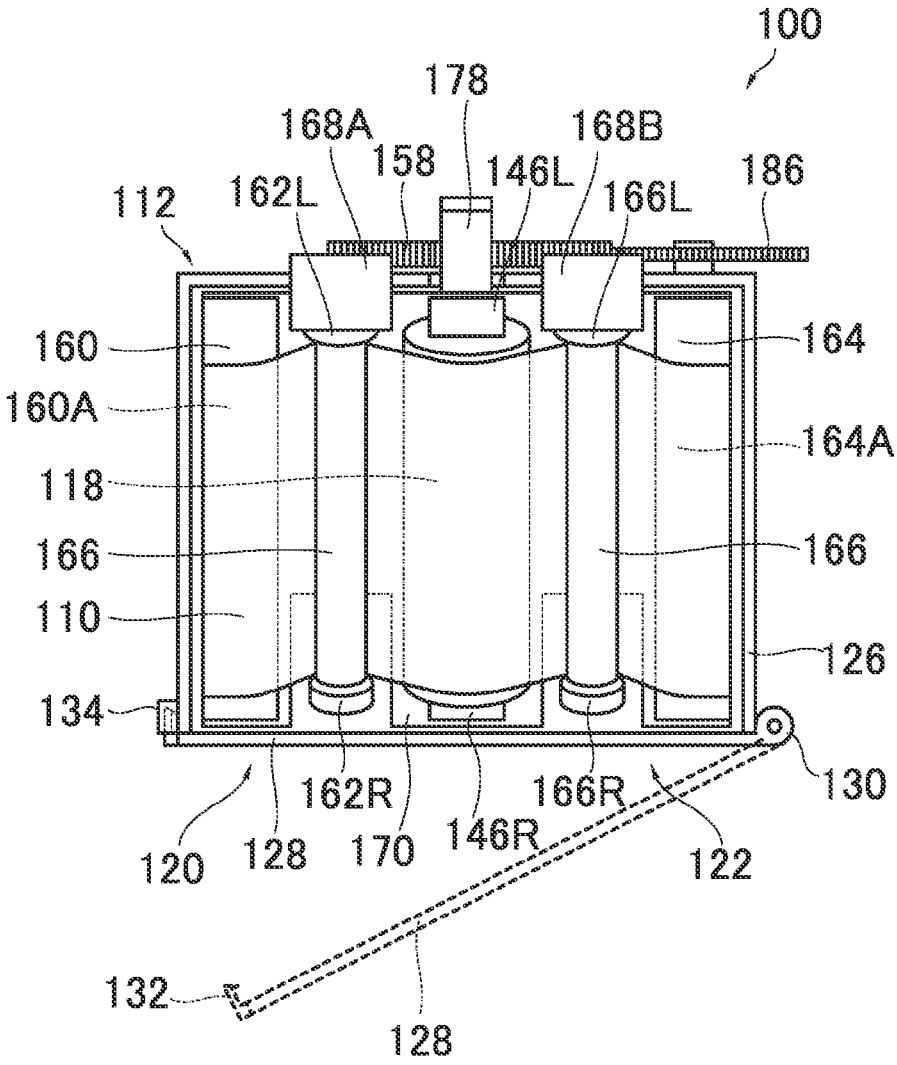
FIG. 9 is a plan diagram of a wiping unit.
Figure 10:
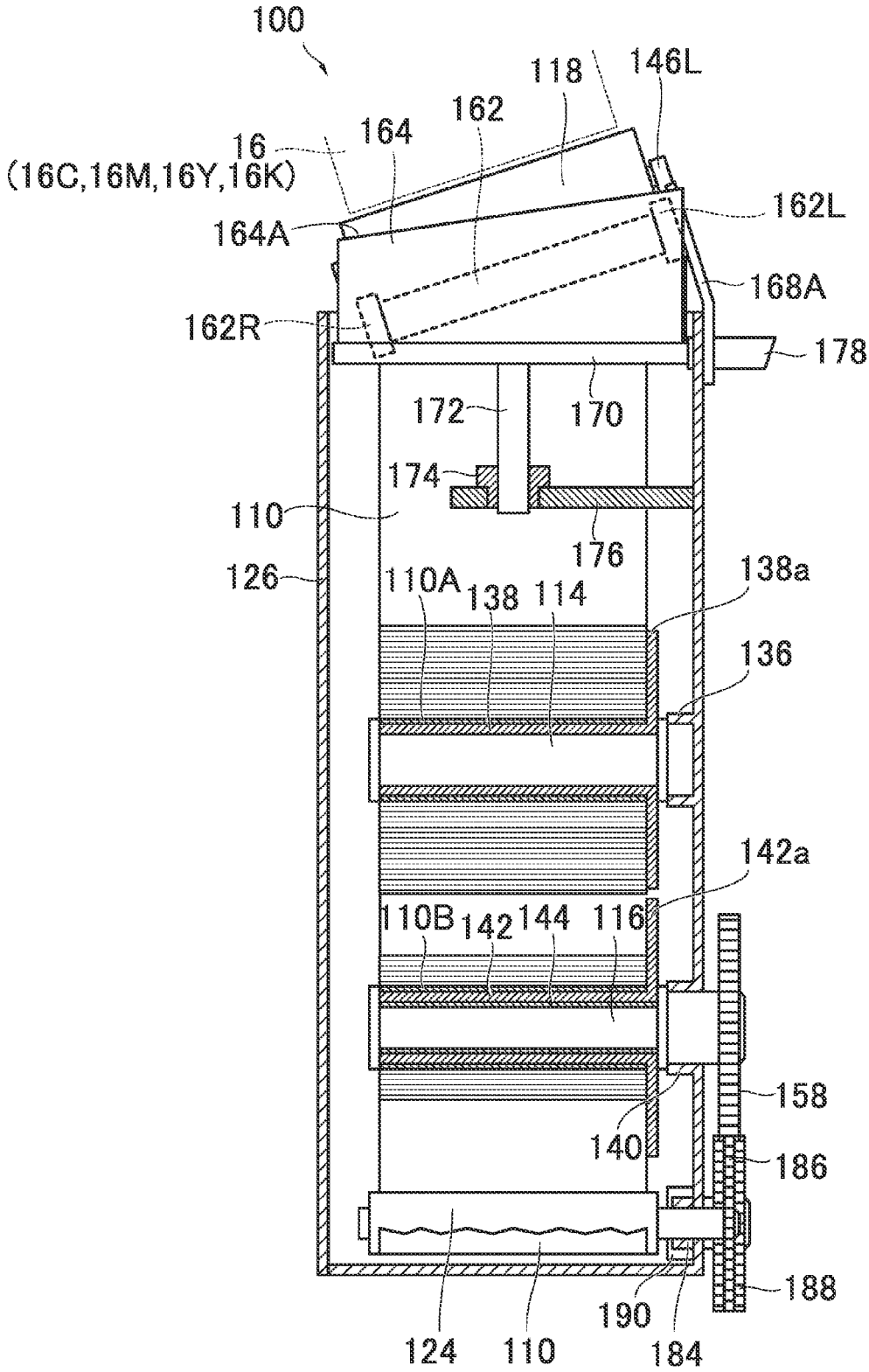
FIG. 10 is a partial cross-sectional side view diagram of the wiping unit.
Figure 11:
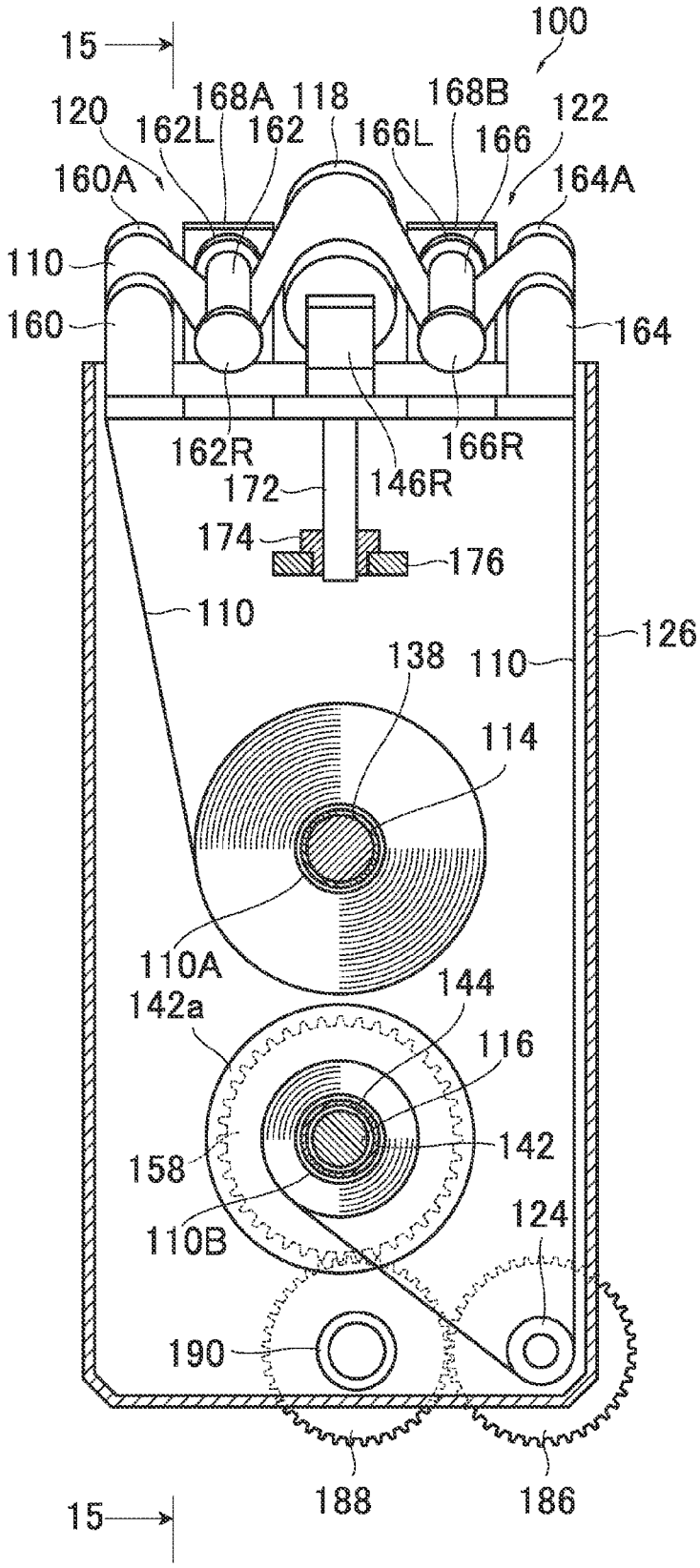
FIG. 11 is a partial cross-sectional front view diagram of the wiping unit.
Figure 12:
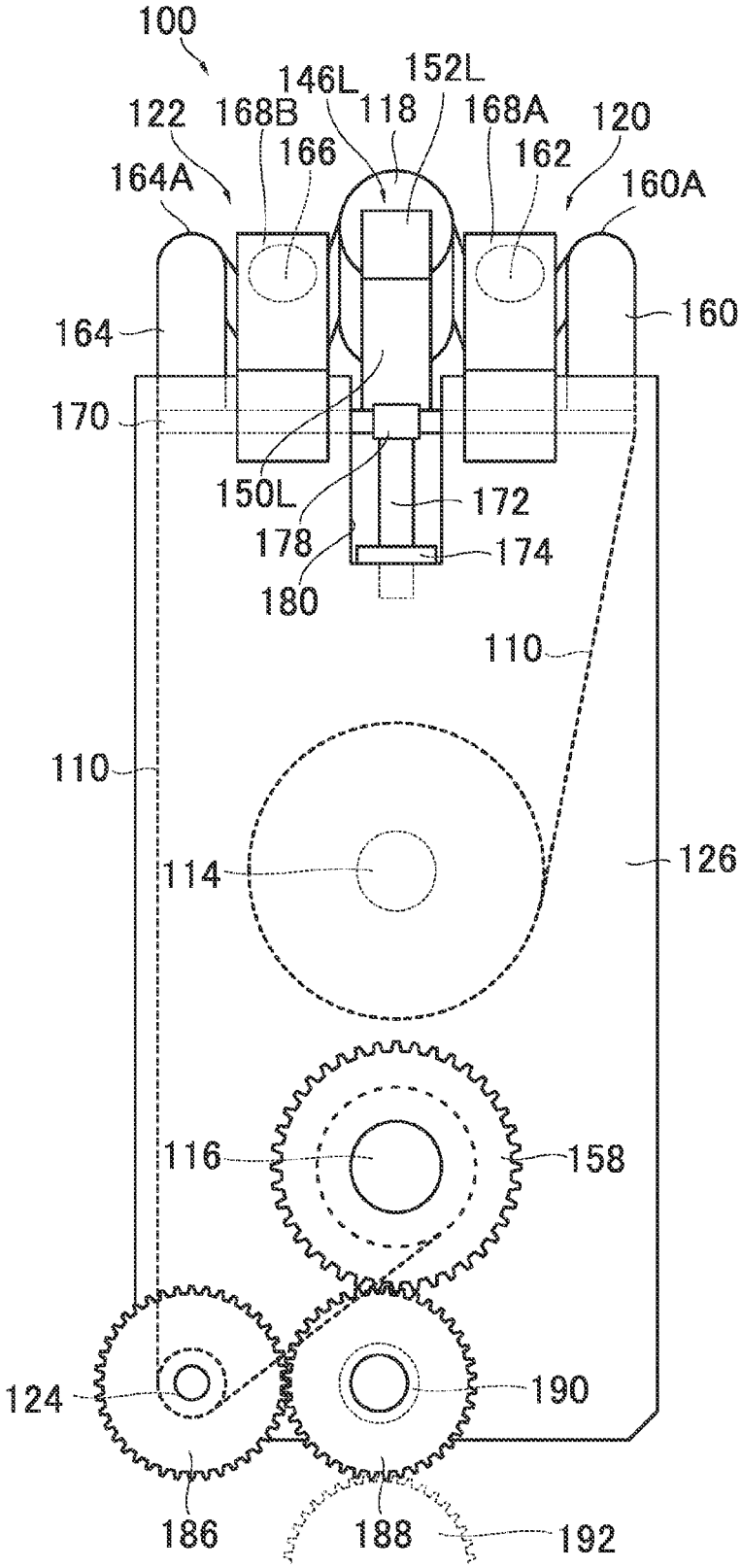
FIG. 12 is a rear view diagram of the wiping unit.

FIG. 9 is a plan diagram of the wiping unit 100, FIG. 10 is a partial cross-sectional side view of the wiping unit 100, FIG. 11 is a partial cross-sectional front view of the wiping unit 100, and FIG. 12 is a rear view of the wiping unit 100.

As shown in FIGS. 9 to 12, the wiping unit 100 has a wiping web 110 formed in a band shape, which is wrapped about a pressing roller 118 obliquely disposed, and the wiping unit 100 wipes and cleans the nozzle surface of the inkjet head by pressing the wiping web 110 wrapped about the pressing roller 118, against the nozzle surface of the inkjet head.

The wiping unit 100 includes: a case 112; a supply spindle 114, which supplies the wiping web 110; a take-up spindle 116, which takes up the wiping web 110; a front-stage guide 120, which guides the wiping web 110 supplied from the supply spindle 114 so as to be wrapped about the pressing roller 118; a rear-stage guide 122, which guides the wiping web 110 having been wrapped about the pressing roller 118 so as to be taken up onto the take-up spindle 116; and a drive roller 124, which drives the wiping web 110.

The case 112 is constituted of a case main body 126 and a lid 128. The case main body 126 is formed in a box shape, which is long in the vertical direction, and the upper end portion and the front face portion thereof are open. The lid 128 is attached to the front face portion of the case main body 126 with a hinge 130. The front face portion of the case main body 126 is opened and closed by means of the lid 128.

The lid 128 is provided with an elastically deformable locking hook 132, and the lid 128 is fixed to the case main body 126 by means of the locking hook 132, which elastically deforms and engages with a hook receiving section 134 formed on the case main body 126.

The supply spindle 114 is disposed so that the axis thereof is horizontal, and the base end portion thereof is rotatably supported on a bearing section 136, which is arranged in the case main body 126. A supply reel 138 having a flange 138*a* on the base end portion thereof is installed on the supply spindle 114. The supply reel 138 is fixed onto the supply spindle 114, and rotates in unison with the supply spindle 114.

As described below, the wiping web 110 which is wrapped in the form of a roll about a winding core 110A is installed on the supply spindle 114 by fitting the winding core 110A onto the supply reel 138.

The take-up spindle 116 is disposed so that the axis thereof is horizontal, at a position below the supply spindle 114. More specifically, the take-up spindle 116 is arranged below and parallel with the supply spindle 114. The vicinity of the base end portion of the take-up spindle 116 is rotatably supported on a bearing section 140, which is arranged in the case main body 126.

A take-up reel 142 having a flange 142*a* on the base end portion thereof is installed on the take-up spindle 116. A sliding member 144 is installed on the inner circumference of the axle portion of the take-up reel 142, and is composed so as to slide with respect to the take-up spindle 116 when a prescribed load or greater is applied in the direction of rotation.

As described below, a winding core 110B which is attached to the leading end of the wiping web 110 is installed on the take-up spindle 116 by fitting onto the take-up reel 142.

Furthermore, the take-up spindle 116 is arranged in such a manner that the base end portion thereof projects to the outer side of the case main body 126, and a take-up gear 158 is fixed to this projecting base end portion of the take-up spindle 116. The take-up spindle 116 is rotated by driving and rotating the take-up gear 158. The related drive system is described hereinafter.

The pressing roller 118 is disposed above the supply spindle 114 (in the present embodiment, the pressing roller 118, the supply spindle 114 and the take-up spindle 116 are disposed on the same straight line), and is arranged at a prescribed inclination with respect to the horizontal plane. In other words, the pressing roller 118 is disposed in accordance with the inclination of the nozzle surface of the inkjet head that is to be cleaned (i.e., the axis of the pressing roller 118 is parallel with the nozzle surface) in order to press the wiping web 110 against the nozzle surface of the inkjet head.

The pressing roller 118 is provided with axle portions 118L and 118R, which project on either end portion thereof, and the axle portions 118L and 118R are supported by a pair of axle supporting sections 146L and 146R in a rotatable and swingable fashion.

Figure 13:
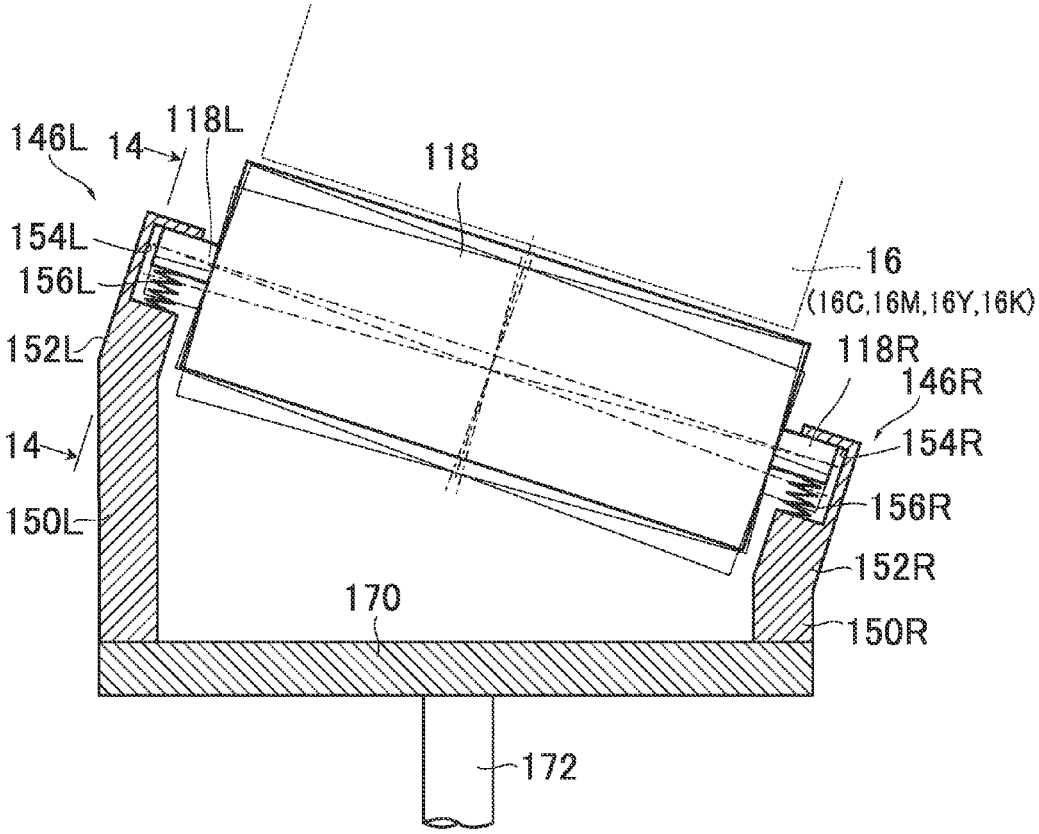
FIG. 13 is a partial cross-sectional front view diagram showing the composition of a bearing section which supports a shaft of a pressing roller.
Figure 14:
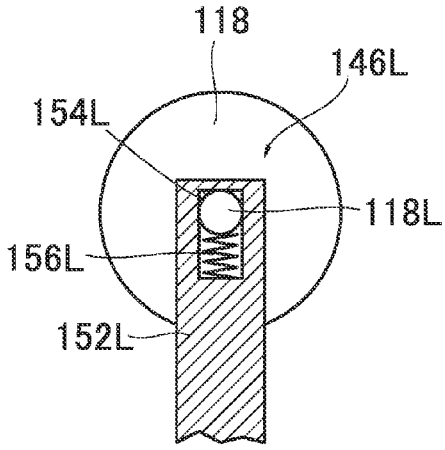
FIG. 14 is a cross-sectional view along line 14-14 in FIG. 13.

FIG. 13 is a partial cross-sectional front view diagram showing the composition of the axle supporting sections which support the axle sections 118L and 118R of the pressing roller 118, and FIG. 14 is a cross-sectional diagram along 14-14 in FIG. 13.

As shown in FIG. 13, the axle supporting sections 146L and the 146R are arranged on an elevator stage 170, which is horizontally disposed. The axle supporting sections 146L and 146R are constituted of pillar sections 150L and 150R, which are vertically erected on the elevator stage 170, and supporting sections 152L and 152R, which are arranged in a bent fashion at the top ends of the pillar sections 150L and 150R.

The supporting sections 152L and 152R are arranged perpendicularly to the axle of the pressing roller 118, and recess sections 154L and 154R are formed in the inner sides thereof. Each of the recess sections 154L and 154R is formed in a rectangular shape, which has a breadth substantially equal to (slightly larger than) the diameter of each of the axle sections 118L and 118R of the pressing roller 118, and the lengthwise direction thereof is perpendicular to the nozzle surface of the inkjet head that is to be cleaned (see FIG. 14). The axle sections 118L and 118R on either end of the pressing roller 118 are fitted freely into the recess sections 154L and 154R of the supporting sections 152L and 152R. Thus, the pressing roller 118 is supported swingably within the plane perpendicular to the nozzle surface of the inkjet head that is to be cleaned.

Springs 156L and 156R are accommodated inside the recess sections 154L and 154R, and the axle sections 118L and 118R of the pressing roller 118 which are fitted freely inside the recess sections 154L and 154R are pressed upward by the springs 156L and 156R. By this means, it is possible to cause the circumferential surface of the pressing roller 118 to make close contact with the nozzle surface, by following the nozzle surface of the line head that is to be cleaned.

The front-stage guide 120 is constituted of a first front-stage guide 160 and a second front-stage guide 162, and the wiping web 110 supplied from the supply spindle 114 is guided so as to wrap about the pressing roller 118, which is obliquely disposed.

On the other hand, the rear-stage guide 122 is constituted of a first rear-stage guide 164 and a second rear-stage guide 166, and the wiping web 110 which has been wrapped about the pressing roller 118 obliquely disposed is guided so as to be taken up onto the horizontally disposed take-up spindle 116.

The front-stage guide 120 and the rear-stage guide 122 are disposed symmetrically about the pressing roller 118. More specifically, the first front-stage guide 160 and the first rear-stage guide 164 are disposed symmetrically about the pressing roller 118, and furthermore the second front-stage guide 162 and the second rear-stage guide 166 are disposed symmetrically about the pressing roller 118.

The first front-stage guide 160 is formed in a plate shape having a prescribed width and is vertically erected on the elevator stage 170. The upper edge portion 160A of the first front-stage guide 160 is formed as a supporting section for the wiping web 110, and the surface thereof is formed in a circular arc shape. Furthermore, the upper edge portion 160A is formed at a prescribed angular inclination with respect to the horizontal plane, whereby the travel direction of the wiping web 110 is changed.

The first rear-stage guide 164 has the same composition as the first front-stage guide 160. More specifically, the first rear-stage guide 164 is formed in a plate shape having a prescribed width and is vertically erected on the elevator stage 170. The upper edge portion 164A is formed as a supporting section for the wiping web 110 and is formed in a circular arc shape. Furthermore, the upper edge portion 164A is formed at a prescribed angular inclination with respect to the horizontal plane.

The first front-stage guide 160 and the first rear-stage guide 164 are disposed symmetrically about the pressing roller 118. The travel direction of the wiping web 110 which has been supplied from the supply spindle 114 is changed to a direction substantially perpendicular to the axis of the pressing roller 118 from the direction perpendicular to the axis of the supply spindle 114, by wrapping the wiping web 110 about the first front-stage guide 160. The travel direction of the wiping web 110 having been wrapped about the second rear-stage guide 166 described below is changed to a direction perpendicular to the axis of the take-up spindle 116 by wrapping the wiping web 110 about the first rear-stage guide 164.

The second front-stage guide 162 is formed as a guide roller having flanges 162L and 162R on the respective end portions thereof. The second front-stage guide 162 is disposed between the first front-stage guide 160 and the pressing roller 118, and guides the wiping web 110 which has wrapped about the first front-stage guide 160 so as to be wrapped about the pressing roller 118. More specifically, the travel direction of the wiping web 110 which has been changed to the direction substantially perpendicular to the axis of the pressing roller 118 by the first front-stage guide 160 is slightly adjusted so that the wiping web 110 travels in the direction just perpendicular to the axis of the pressing roller 118. Furthermore, skewed travel of the wiping web 110 is prevented by the flange sections 162L and 162R on the respective ends of the first front-stage guide 160.

Figure 15:
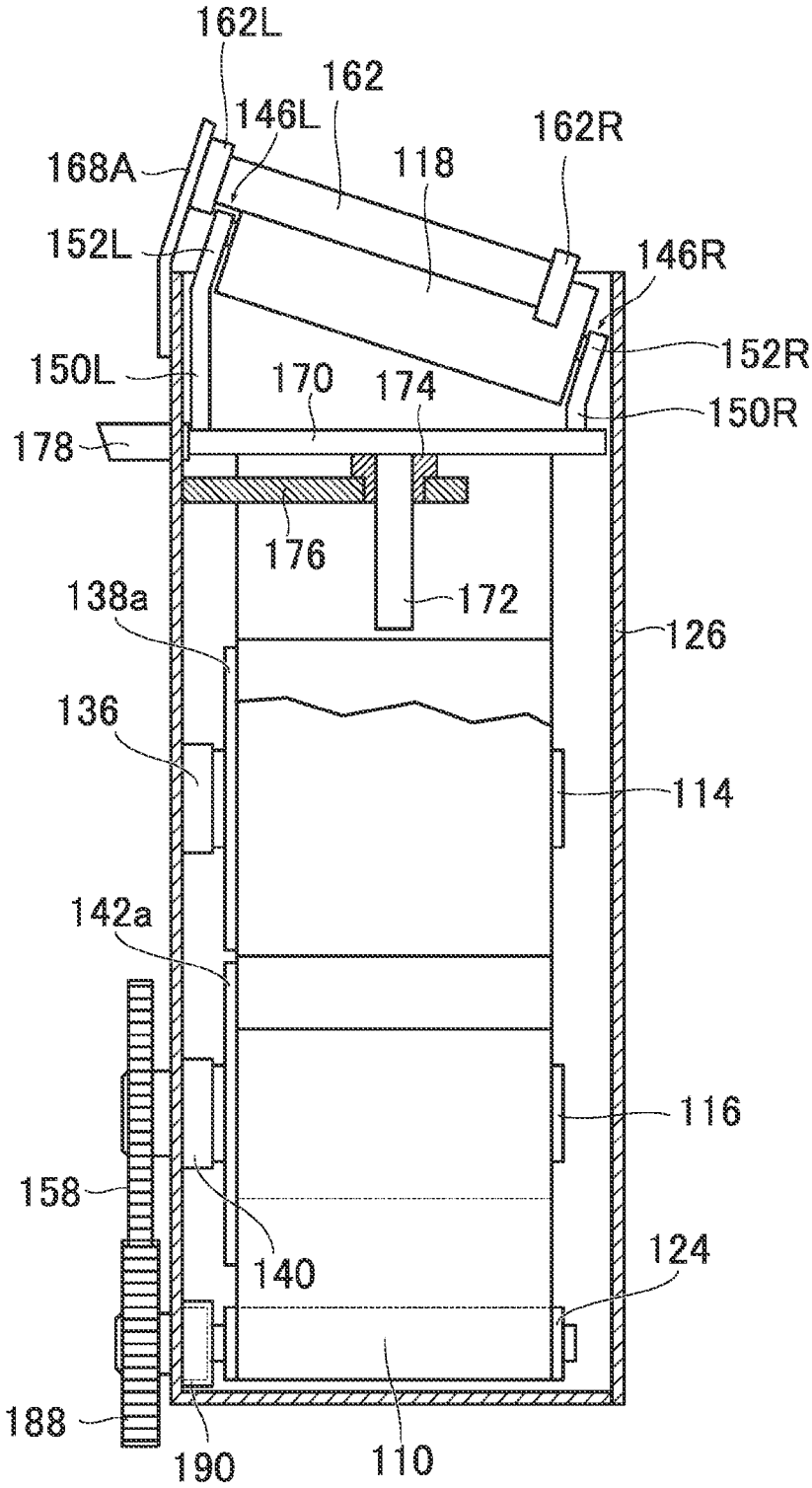
FIG. 15 is a cross-sectional view along line 15-15 in FIG. 11.

The second front-stage guide 162 is supported at only one end thereof on a bracket 168A, and the second front-stage guide 162 is disposed at a prescribed angular inclination. As shown in FIGS. 12 and 15, the bracket 168A is formed in a plate shape with a bent top end, and the base end portion of the bracket 168A is fixed to the upper end portion of the rear face of the case main body 126. The bracket 168A is arranged so as to project perpendicularly upward from the upper end portion of the case main body 126. The second front-stage guide 162 is rotatably supported at only one end thereof on the bent portion of the top end of the bracket 168A.

The second rear-stage guide 166 has the same composition as the second front-stage guide 162. More specifically, the second rear-stage guide 166 is formed as a guide roller having flanges 166L and 166R on either end portion thereof, and the second rear-stage guide 166 is supported at only one end thereof on a bracket 168B. The second rear-stage guide 166 is arranged at a prescribed angular inclination. The bracket 168B is formed in a plate shape with a bent top end, and the base end portion of the bracket 168B is fixed to the upper end portion of the rear face of the case main body 126. The second rear-stage guide 166 is rotatably supported at only one end thereof on the bent portion of the top end of the bracket 168B.

The second rear-stage guide 166 is disposed between the pressing roller 118 and the first rear-stage guide 164, and guides the wiping web 110 which has been wrapped about the pressing roller 118 so as to be wrapped about the first rear-stage guide 164.

The second front-stage guide 162 and the second rear-stage guide 166 are disposed symmetrically about the pressing roller 118. The wiping web 110 of which the travel direction has been changed to the direction substantially perpendicular to the axis of the pressing roller 118 by the first front-stage guide 160 is wrapped about the second front-stage guide 162, whereby the travel direction of the wiping web 110 is slightly adjusted so that the wiping web 110 travels in the direction just perpendicular to the axis of the pressing roller 118. Furthermore, the travel direction of the wiping web 110 having been wrapped about the pressing roller 118 is slightly adjusted by the second rear-stage guide 166 so that the wiping web 110 can be wrapped about the first rear-stage guide 164. By wrapping the wiping web 110 about the first rear-stage guide 164, the travel direction of the wiping web 110 is changed to the direction perpendicular to the axis of the take-up spindle 116.

Thus, the front-stage guide 120 and the rear-stage guide 122 guide the wiping web 110 by gradually changing the travel direction of the wiping web 110, so that the wiping web 110 can be wrapped about the pressing roller 118 readily.

Consequently, the angle of inclination of the second front-stage guide 162 is closer to the angle of inclination of the pressing roller 118 than the angle of inclination of the first front-stage guide 160, and similarly, the angle of inclination of the second rear-stage guide 166 is closer to the angle of inclination of the pressing roller 118 than the angle of inclination of the first rear-stage guide 164.

As described above, the first front-stage guide 160, the pressing roller 118 and the first rear-stage guide 164 (the first structural body constituted of the first front-stage guide 160, the pressing roller 118 and the first rear-stage guide 164) are arranged on the elevator stage 170. The elevator stage 170 can be raised and lowered in the direction vertical to the horizontal plane.

As shown in FIG. 10, a guide shaft 172 is connected integrally with the elevator stage 170. The guide shaft 172 vertically extends downward from the lower face of the elevator stage 170 and is fitted into a guide bush 174 disposed inside the case main body 126. The guide bush 174 is fixed to the inner wall face of the case main body 126 through a supporting member 176, and guides the guide shaft 172 vertically.

Figure 16A:
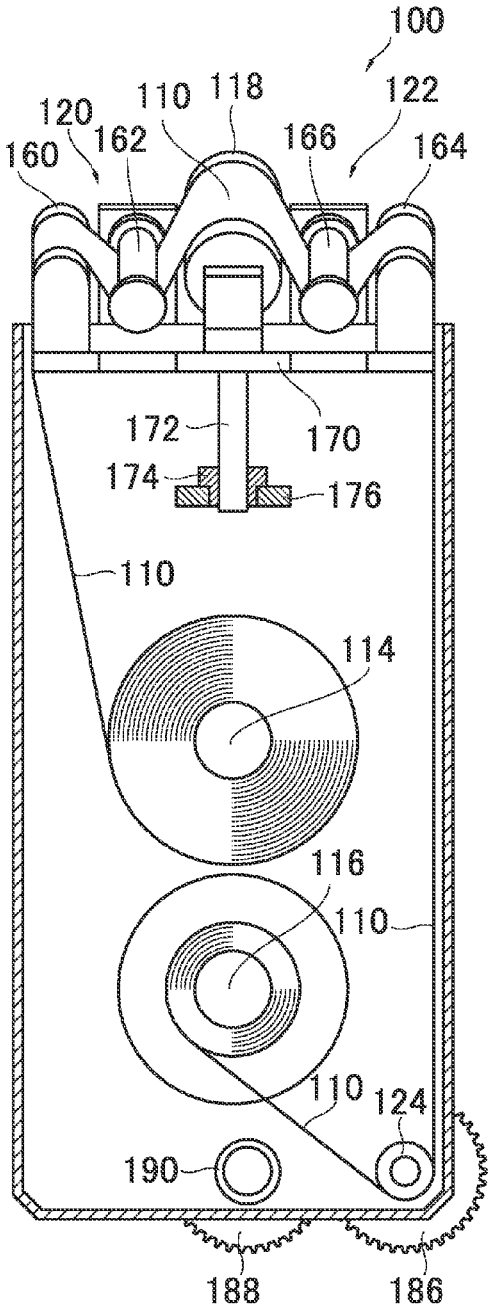
FIG. 16A is an illustrative diagram showing a state of a wiping web in the wiping unit during use.
Figure 16B:
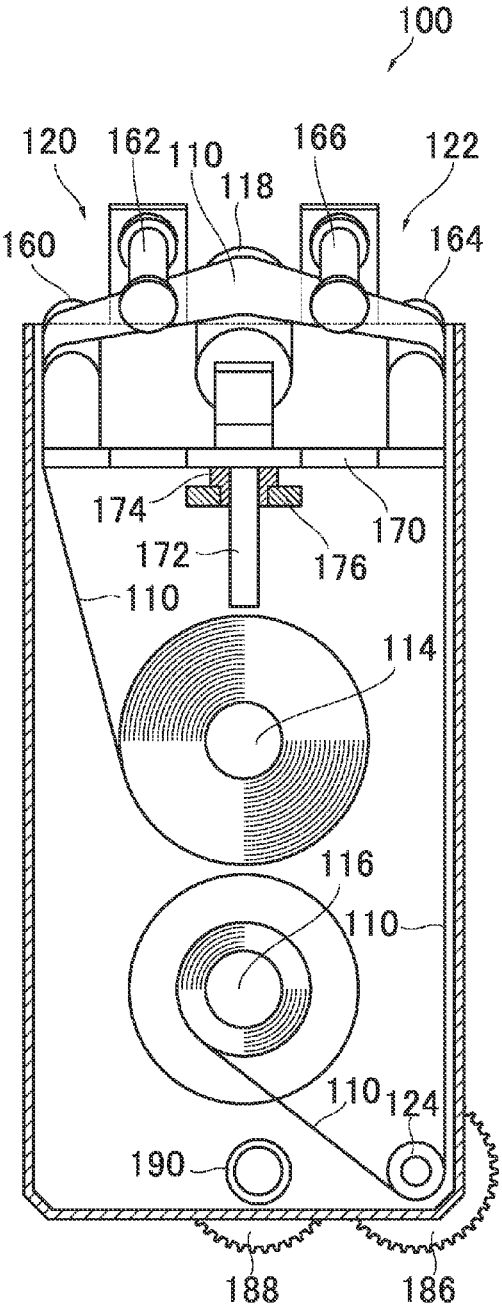
FIG. 16B is an illustrative diagram showing a state of the wiping web during replacement.

In this way, the elevator stage 170 on which the first front-stage guide 160, the pressing roller 118 and the first rear-stage guide 164 are disposed is arranged raisably and lowerably in the direction vertical to the horizontal plane. Therefore, as shown in FIGS. 16A and 16B, by raising and lowering the elevator stage 170, it is possible to cause the first front-stage guide 160, the pressing roller 118 and the first rear-stage guide 164 to advance and retreat with respect to the second front-stage guide 162 and the second rear-stage guide 166 (the second structural body constituted of the second front-stage guide 162 and the second rear-stage guide 166), which are fixedly arranged. By this means, it is possible to simply replace the wiping web 110.

More specifically, by lowering the elevator stage 170, as shown in FIG. 16B, the first front-side guide 160, the pressing roller 118 and the first rear-stage guide 164 can be retracted downward with respect to the second front-stage guide 162 and the second rear-stage guide 166, and therefore a large space between same can be ensured. Thereby, it is possible to simply carry out the task of wrapping the wiping web 110 about the respective sections. Furthermore, the wiping web 110 can be simply wrapped about the respective sections by wrapping the wiping web 110 about the first front-stage guide 160, the pressing roller 118 and the first rear-stage guide 164, with the first front-stage guide 160, the pressing roller 118 and the first rear-stage guide 164 in the downwardly retracted state, and then raising the elevator stage 170. In other words, if the wiping web 110 is wrapped about the first front-stage guide 160, the pressing roller 118 and the first rear-stage guide 164, whereupon the elevator stage 170 is raised, as shown in FIG. 16A, then the wiping web 110 is automatically wrapped about the second front-stage guide 162 and the second rear-stage guide 166.

In this way, by making the first front-stage guide 160, the pressing roller 118 and the first rear-stage guide 164 capable of advancing and retracting with respect to the second front-stage guide 162 and the second rear-stage guide 166, it is possible to simply carry out the task of replacing the wiping web 110.

The first front-stage guide 160, the pressing roller 118 and the first rear-stage guide 164 need to be positioned in the prescribed use position (the position in FIG. 16A) when being used, and the first front-stage guide 160, the pressing roller 118 and the first rear-stage guide 164 are moved to the use position in coordination with the installation of the wiping unit 100 on the rack 102.

This coordinated mechanism will now be described. As shown in FIGS. 10 and 12, an elevator lever (engagement section) 178 is arranged on the elevator stage 170, on which the first front-stage guide 160, the pressing roller 118 and the first rear-stage guide 164 are arranged. The elevator lever 178 is arranged so as to project from the rear face of the case main body 126 through a cutaway portion 180 formed on the rear face of the case main body 126. The elevator stage 170 is raised and lowered by sliding the elevator lever 178.

Figure 17A:
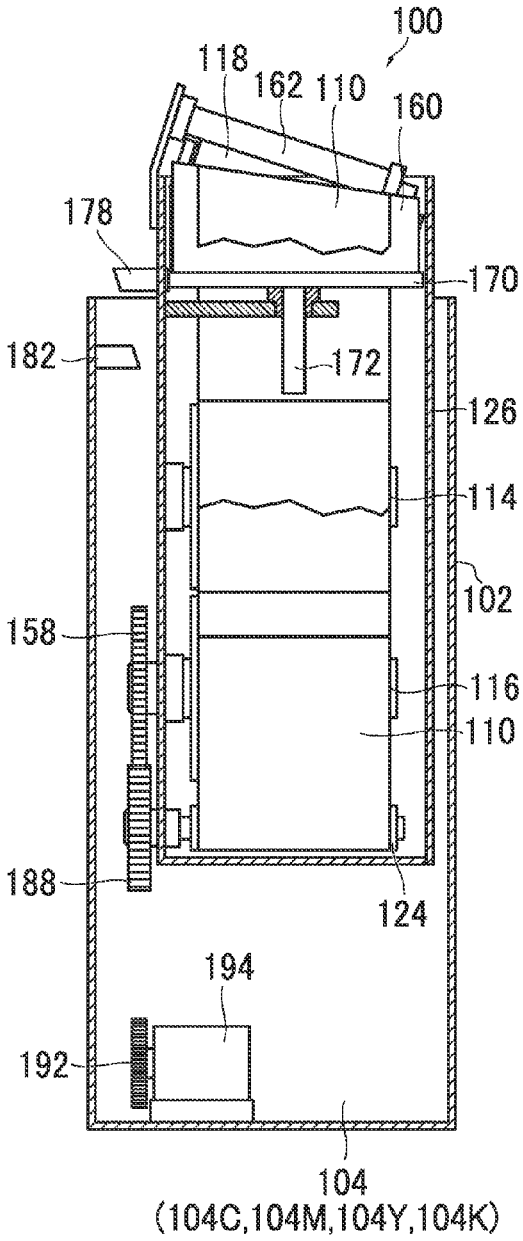
FIGS. 17A and 17B are illustrative diagrams of a coordination mechanism for raising and lowering an elevator table.
Figure 17B:
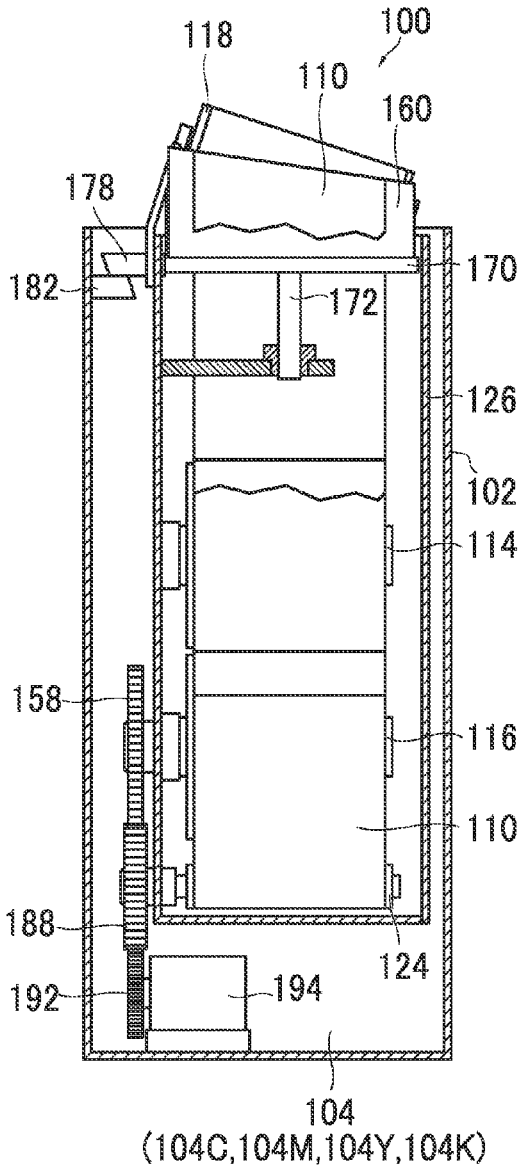

On the other hand, as shown in FIGS. 17A and 17B, a pin (engaged section) 182 is projectingly arranged on the inner side of the installation section 104 (104C, 104M, 104Y and 104K) of the rack 102 in which the wiping unit 100 is set. The pin 182 is arranged so as to engage with the elevator lever 178 arranged on the wiping unit 100 when the wiping unit 100 is installed on the installation section 104.

According to the composition described above, as shown in FIGS. 17A and 17B, when the wiping unit 100 is inserted into the installation section 104 of the rack 102, the elevator lever 178 engages with the pin 182 and is forcibly raised up to a prescribed position. Thereby, the first front-stage guide 160, the pressing roller 118 and the first rear-stage guide 164 are registered in the prescribed use position.

In this way, the first front-stage guide 160, the pressing roller 118 and the first rear-stage guide 164 are moved to the use position in coordination with the installation of the wiping unit 100 on the rack 102.

The drive roller 124 is disposed in the vicinity of the base face of the case main body 126, in a position below the first rear-stage guide 164. The drive roller 124 drives and guides the wiping web 110 of which the travel direction has been changed to the direction perpendicular to the take-up spindle 116 by the first rear-stage guide 164, so that the wiping web 110 is taken up onto the take-up spindle 116.

The drive roller 124 is arranged in parallel with the take-up spindle 116 (namely in parallel with the horizontal plane), and the vicinity of the base end portion thereof is rotatably supported on a bearing section 184, which is arranged on the case main body 126.

Furthermore, the drive roller 124 is arranged in such a manner that the base end portion of the rotating shaft thereof projects to the outer side of the case main body 126, and a roller drive gear 186 is fixed to this projecting base end portion of the rotating shaft. The drive roller 124 is rotated by driving the roller drive gear 186 to rotate.

Here, the drive system of the wiping unit 100 including the drive roller 124 is described.

In the wiping unit 100 according to the present embodiment, by driving the take-up spindle 116 to rotate while also driving the drive roller 124 to rotate, the wiping web 110 is caused to travel from the supply spindle 114 toward the take-up spindle 116.

As described above, the take-up gear 158 is fixed to the base end portion of the take-up spindle 116, and the roller drive gear 186 is fixed to the base end portion of the rotating shaft of the drive roller 124. As shown in FIG. 12, the take-up gear 158 and the roller drive hear 186 mesh with an idle gear 188.

The rotating shaft of the idle gear 188 is horizontally arranged and is rotatably supported on a bearing section 190 arranged on the case main body 126. The take-up gear 158 and the roller drive gear 186 are both caused to rotate in the same direction by driving the idle gear 188. The idle gear 188 meshes with a drive gear 192 arranged inside the installation section 104 when the wiping unit 100 is installed in the installation section 104 of the rack 102. More specifically, as shown in FIGS. 17A and 17B, a motor 194 forming a source of drive power is arranged in the base portion of the installation section 104, and the idle gear 188 meshes with the drive gear 192, which is fixed to the output shaft of the motor 194, when the wiping unit 100 is installed in the installation section 104 of the rack 102.

In this way, the idle gear 188 meshes with the drive gear 192 arranged inside the installation section 104 when the wiping unit 100 is installed in the installation section 104 of the rack 102. When the drive gear 192 is caused to rotate by the motor 194, the idle gear 188 rotates and this rotation of the idle gear 188 is transmitted to the roller drive gear 186 of the take-up gear 158, thereby rotating the take-up spindle 116 and the drive roller 124. Due to the rotation of the take-up spindle 116 and the driver roller 124, the wiping web 110 is supplied from the supply spindle 114, and taken up onto the take-up spindle 116 after passing along a prescribed path of travel.

As described above, the sliding member 144 is installed on the inner circumference of the axle portion of the take-up reel 142, which is installed on the take-up spindle 116, and the take-up reel 142 is composed so as to slide with respect to the take-up spindle 116 when the prescribed load or greater is applied in the direction of rotation. Consequently, the sliding member 144 slides if a velocity difference occurs between the take-up spindle 116 and the drive roller 124, and therefore allows the wiping web 110 to be conveyed at a uniform velocity at all times.

The wiping units 100 (100C, 100M, 100Y, 100K) are composed as described above. The wiping device 64 is composed by installing the wiping units 100C, 100M, 100Y and 100K on the rack 102.

The operation of the wiping device 64 is controlled by a controller, which is not illustrated. The controller controls the wiping operation by the wiping device 64 by controlling the driving of the elevator device, motor 194, and the like.

<Action of Wiping Device>

Next, the action of the wiping device 64 according to the present embodiment having the aforementioned composition is described.

<<Installation of Wiping Web>>

The method of installation the wiping web 110 on the wiping unit 100 is described.

The wiping web 110 is formed in a band shape having the prescribed width, and the winding cores 110A and 110B are attached respectively to either end thereof. The wiping web 110 is supplied in the form of a roll wound up onto the winding core 110A, one of the winding cores.

Firstly, the wiping unit 100 is taken out from the rack 102 and the lid 128 of the case 112 is opened. Upon opening the lid 128, the supply reel 138 which is installed on the supply spindle 114 and the take-up reel 142 which is installed on the take-up spindle 116 are exposed, and then the winding cores 110A and 110B of the wiping web 110 are installed respectively on the supply reel 138 and the take-up reel 142. The winding cores 110A and 110B of the wiping web 110 are installed on the supply reel 138 and the take-up reel 142 while the wiping web 110 is being wrapped about the first front-stage guide 160, the pressing roller 118, the first rear-stage guide 164 and the drive roller 124.

More specifically, firstly, the winding core 110A on which the wiping web 110 is wound in the form of a roll is installed on the supply reel 138.

Thereupon, the wiping web 110 is unwound by a prescribed amount from the winding core 110A, passed below the second front-stage guide 162 and the second rear-stage guide 166, and also wrapped about the upper side of the first front-stage guide 160, the pressing roller 118 and the first rear-stage guide 164. At this time, the wiping web 110 is wrapped about the first front-stage guide 160, the pressing roller 118 and the first rear-stage guide 164 while the elevator stage 170 is in the lowered state, in other words, while the first front-stage guide 160, the pressing roller 118 and the first rear-stage guide 164 are in the downwardly retracted state. Thereby, it is possible to ensure sufficient space with respect to the second front-stage guide 162 and the second front-stage guide 166, and the wiping web 110 can be easily wrapped about the first front-stage guide 160, the pressing roller 118 and the first rear-stage guide 164 by passing below the second front-stage guide 162 and the second rear-stage guide 166.

The wiping web 110 wrapped about the first front-stage guide 160, the pressing roller 118 and the first rear-stage guide 164 is further wrapped about the drive roller 124, and finally the winding core 110B on the leading end thereof is installed on the take-up reel 142. Thus, installation of the wiping web 110 is completed. Thereafter, the wiping web 110 is wound back onto the winding core 110A as necessary, thereby eliminating slack in the wiping web 110, and the lid 128 of the case 112 is then closed.

<<Setting in Rack>>

Next, the wiping unit 100 in which the wiping web 110 has been installed in set in the rack 102.

The wiping unit 100 is set in the rack 102 by vertically inserting the wiping unit 100 into the installation section 104 formed in the rack 102.

When the wiping unit 100 has been set in the installation section 104 of the rack 102, as shown in FIG. 17B, the idle gear 188 of the wiping unit 100 meshes with the drive gear 192 arranged on the installation section 72, and thus becomes rotatably drivable by the motor 194, which is coupled to the drive gear 192.

Furthermore, when the wiping unit 100 is set in the installation section 104 of the rack 102, the elevator lever 178 arranged on the elevator stage 170 engages with the pin 182 arranged on the installation section 104, and the elevator stage 170 is forcibly raised up to the prescribed position. Thereby, the first front-stage guide 160, the pressing roller 118 and the first rear-stage guide 164 are registered in the prescribed use position. By registering the first front-stage guide 160, the pressing roller 118 and the first rear-stage guide 164 in the prescribed use position, the wiping web 110 becomes wrapped about the second front-stage guide 162, which is disposed between the first front-stage guide 160 and the pressing roller 118, and furthermore the wiping web 110 also becomes wrapped about the second rear-stage guide 166, which is disposed between the pressing roller 118 and the first rear-stage guide 164. Thereby, the wiping web 110 is tautly wrapped about the circumferential surface of the pressing roller 118.

Thus, the setting of the wiping unit 100 in the rack 102 is completed.

In the thus set wiping unit 100 in the rack 102, by driving the motor 194, the wiping web 110 is supplied from the supply spindle 114 and taken up onto the take-up spindle 116 after passing along a prescribed path of travel.

Furthermore, as shown in FIG. 8, the pressing rollers 118 of the wiping units 100C, 100M, 100Y and 100K, which correspond respectively to the inkjet heads 16C, 16M, 16Y and 16K disposed with their nozzle surfaces 30C, 30M, 30Y and 30K at the inclinations with respect to the horizontal plane, are positioned in parallel with the nozzle surfaces 30C, 30M, 30Y and 30K, respectively. Thus, it is possible to cause the wiping webs 110 wrapped about the respective pressing rollers 118 to make tight contact with the corresponding nozzle surfaces 30C, 30M, 30Y and 30K.

<<Wiping Operation>>

Similarly to the cleaning liquid deposition device 62, the wiping device 64 wipes and cleans the nozzle surfaces 30 (30C, 30M, 30Y, 30K) of the inkjet heads 16 (16C, 16M, 16Y, 16K) while the inkjet heads move from the image recording position to the maintenance position. More specifically, the nozzle surfaces are wiped as follows.

The whole of the wiping device 64 is arranged raisable and lowerable. When not performing cleaning, the wiping device 64 is disposed in a prescribed standby position. During cleaning, the wiping apparatus 64 is raised by a prescribed amount from the standby position to a prescribed operating position.

When the wiping device 64 is moved to the operating position, the nozzle surfaces 30C, 30M, 30Y and 30K of the inkjet heads 16C, 16M, 16Y and 16K can be wiped by the wiping units 100C, 100M, 100Y and 100K. More specifically, when the inkjet heads 16C, 16M, 16Y and 16K pass the respective wiping units 100C, 100M, 100Y and 100K, it is possible for the wiping webs 110 wound about the pressing rollers 118 to abut and press against the nozzle surfaces 30C, 30M, 30Y and 30K.

When the inkjet heads 16C, 16M, 16Y and 16K in which the cleaning liquid has been deposited on the nozzle surfaces 30C, 30M, 30Y and 30K by the cleaning liquid deposition device 62 are moved in this state toward the maintenance position, during the course of this movement, the wiping webs 110 abut and press against the nozzle surfaces 30C, 30M, 30Y and 30K.

The controller drives the motors 194 and causes the wiping webs 110 to travel, in accordance with the timing at which the inkjet heads 16C, 16M, 16Y and 16K arrive at the wiping units 100C, 100M, 100Y and 100K. Thereby, the traveling wiping webs 110 abut and press against the nozzle surfaces 30C, 30M, 30Y and 30K, thus wiping and cleaning the nozzle surfaces 30C, 30M, 30Y and 30K.

In this operation, since the excess cleaning liquid has been removed from the nozzle surfaces 30C, 30M, 30Y and 30K, then it is possible to wipe the nozzle surfaces 30C, 30M, 30Y and 30K reliably, without any decline in the absorbing capability of the wiping webs 110.

<Action of Nozzle Surface Cleaning Apparatus>

The nozzle surface cleaning apparatus 60 according to the present embodiment is composed as described above.

Next, a nozzle surface cleaning operation performed by the nozzle surface cleaning apparatus 60 in the present embodiment is described.

The cleaning of the nozzle surfaces is performed while the inkjet heads 16C, 16M, 16Y and 16K are moved from the image recording position to the maintenance position.

When a nozzle surface cleaning instruction is input to the controller, the controller moves the cleaning liquid deposition device 62 and the wiping device 64 to the prescribed operating positions. By this means, deposition of the cleaning liquid and wiping become possible.

After the cleaning liquid deposition device 62 and the wiping device 64 are moved to the prescribed operating positions, the controller causes the head supporting frame 40 to move from the image recording position to the maintenance position at a prescribed movement speed.

On the other hand, the controller also drives the cleaning liquid supply pump 228 in accordance with the timing at which the inkjet heads 16C, 16M, 16Y and 16K arrive at the cleaning liquid deposition heads 210 of the cleaning liquid deposition units 200C, 200M, 200Y and 200K. Thereby, the cleaning liquid flows out at a prescribed flow rate from the cleaning liquid emission ports 218 of the cleaning liquid deposition heads 210 in the respective cleaning liquid deposition units 200C, 200M, 200Y and 200K. The cleaning liquid which has flowed out from the cleaning liquid emission ports 218 flows down over the cleaning liquid holding surfaces 216.

When the inkjet heads 16C, 16M, 16Y and 16K moving toward the maintenance position pass the cleaning liquid deposition heads 210, the cleaning liquid which has flowed over the cleaning liquid holding surfaces 216 of the cleaning liquid deposition heads 210 contacts the nozzle surfaces 30C, 30M, 30Y and 30K, and the cleaning liquid is thereby deposited on the nozzle surfaces 30C, 30M, 30Y and 30K.

Thereupon, the squeegees 212 are pressed against the lower edge portions of the nozzle surfaces 30C, 30M, 30Y and 30K on which the cleaning liquid has been deposited, and excess cleaning liquid which collects in the lower edge portions in the direction of inclination is swept with the squeegees 212.

The inkjet heads 16C, 16M, 16Y and 16K from the nozzle surfaces of which excess cleaning liquid has been swept are then moved toward the maintenance position and during the course of this movement, the wiping webs 110 are pressed against the nozzle surfaces 30C, 30M, 30Y and 30K.

The controller drives the motors 194 and causes the wiping webs 110 to travel, in accordance with the timing at which the inkjet heads 16C, 16M, 16Y and 16K arrive at the wiping units 100C, 100M, 100Y and 100K. Thereby, the traveling wiping webs 110 abut and press against the nozzle surfaces 30C, 30M, 30Y and 30K, thus wiping and cleaning the nozzle surfaces 30C, 30M, 30Y and 30K.

When the nozzle surfaces 30C, 30M, 30Y and 30K have completely passed the cleaning liquid deposition units 200C, 200M, 200Y and 200K, the driving of the cleaning liquid supply pump 228 is halted and the supply of cleaning liquid is halted. Thereupon, the cleaning liquid deposition device 62 is withdrawn to the standby position.

When the nozzle surfaces 30C, 30M, 30Y and 30K have completely passed the wiping units 100C, 100M, 100Y and 100K, the driving of the motors 194 is halted and the travel of the wiping webs 110 is halted. Thereupon, the wiping device 64 is withdrawn to the standby position.

The cleaning of the nozzle surfaces 30C, 30M, 30Y and 30K of the inkjet heads 16C, 16M, 16Y and 16K is completed by the series of steps described above.

As described above, in the nozzle surface cleaning apparatus 60 according to the present embodiment, when the cleaning liquid has been deposited onto the nozzle surfaces 30C, 30M, 30Y and 30K from the cleaning liquid deposition heads 210 in the cleaning liquid deposition device 62, the excess cleaning liquid which collects on the lower edge portions of the nozzle surfaces 30C, 30M, 30Y and 30K in the direction of inclination is swept with the squeegees 212. Thereby, it is possible to prevent excess cleaning liquid from dripping down during movement of the inkjet heads and soiling the peripheral area. Furthermore, it is possible to prevent the wiping capability of the wiping webs 110 declining with the wiping step in the latter stage and giving rise to insufficient wiping. In particular, this is especially useful when using wiping webs 110 having absorbency, since they display marked decline in the absorption capacity due to the presence of residual excess cleaning liquid.

Figure 18:
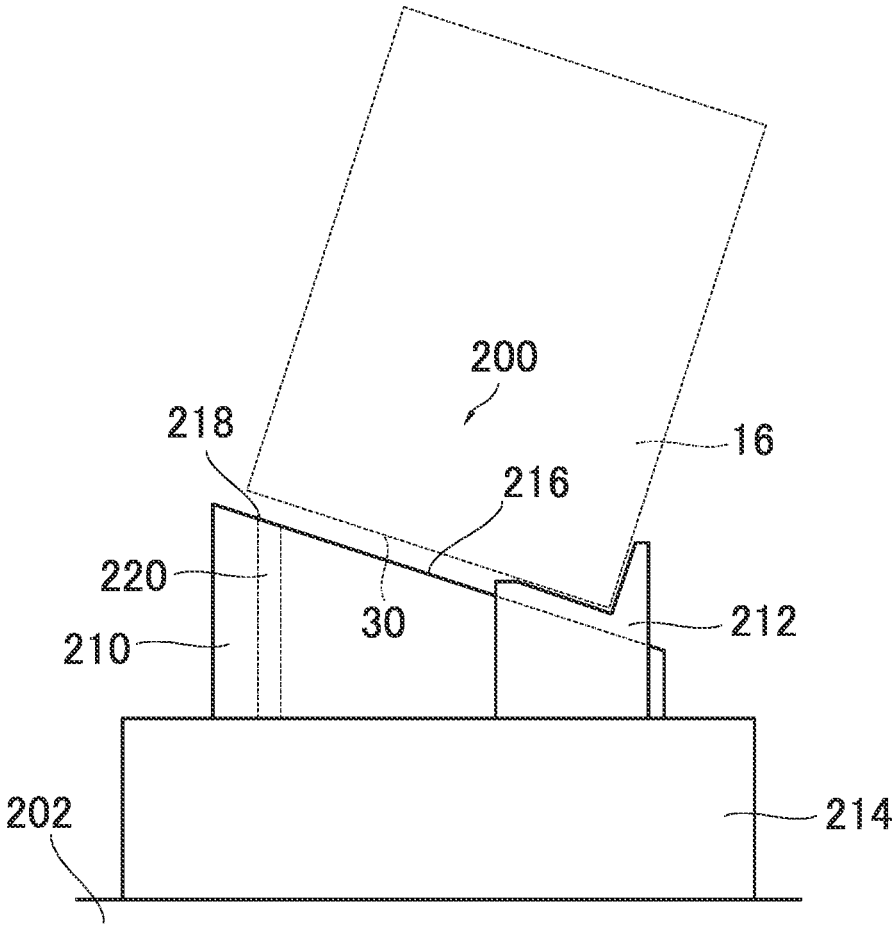
FIG. 18 is a diagram showing a further mode of a squeegee.

In the above-described embodiment, the squeegees 212 are composed to abut only against the nozzle surfaces 30; however, it is desirable that as shown in FIG. 18, the tip portion of each squeegee 212 is formed in a V-shape and the squeegee 212 also abuts against the side wall surface of the inkjet head on the lower side of the direction of inclination. By this means, it is possible to remove the excess cleaning liquid more reliably. More specifically, since the excess cleaning liquid may descend and bend back inside the side wall surface, then it is possible to remove the excess cleaning liquid which has collected in the lower edge portions of the direction of inclination, in a more reliable way, by pressing the squeegee 212 against the side wall surface also.

Furthermore, in the present embodiment, the cleaning liquid deposition head 210 and the squeegee 212 are integrally installed on the cleaning liquid recovery tray 214, but the cleaning liquid deposition head 210 and the squeegee 212 can be composed separately.

Second Embodiment

In the nozzle surface cleaning apparatus according to the first embodiment of the present invention, the composition is adopted in which the excess cleaning liquid is removed from the nozzle surface 30 by sweeping with the squeegee 212, the excess cleaning liquid which has collected on the lower edge portion of the nozzle surface 30 in the direction of inclination.

In the nozzle surface cleaning apparatus according to the second embodiment of the present invention, the excess cleaning liquid which has collected on the lower edge portion of the nozzle surface 30 in the direction of inclination is removed by suctioning. Apart from the composition for removing the excess cleaning liquid, the composition of the nozzle surface cleaning apparatus in the second embodiment is the same as the nozzle surface cleaning apparatus in the above-described first embodiment, and therefore only the composition for suctioning and removing the excess cleaning liquid is described here.

Figure 19:
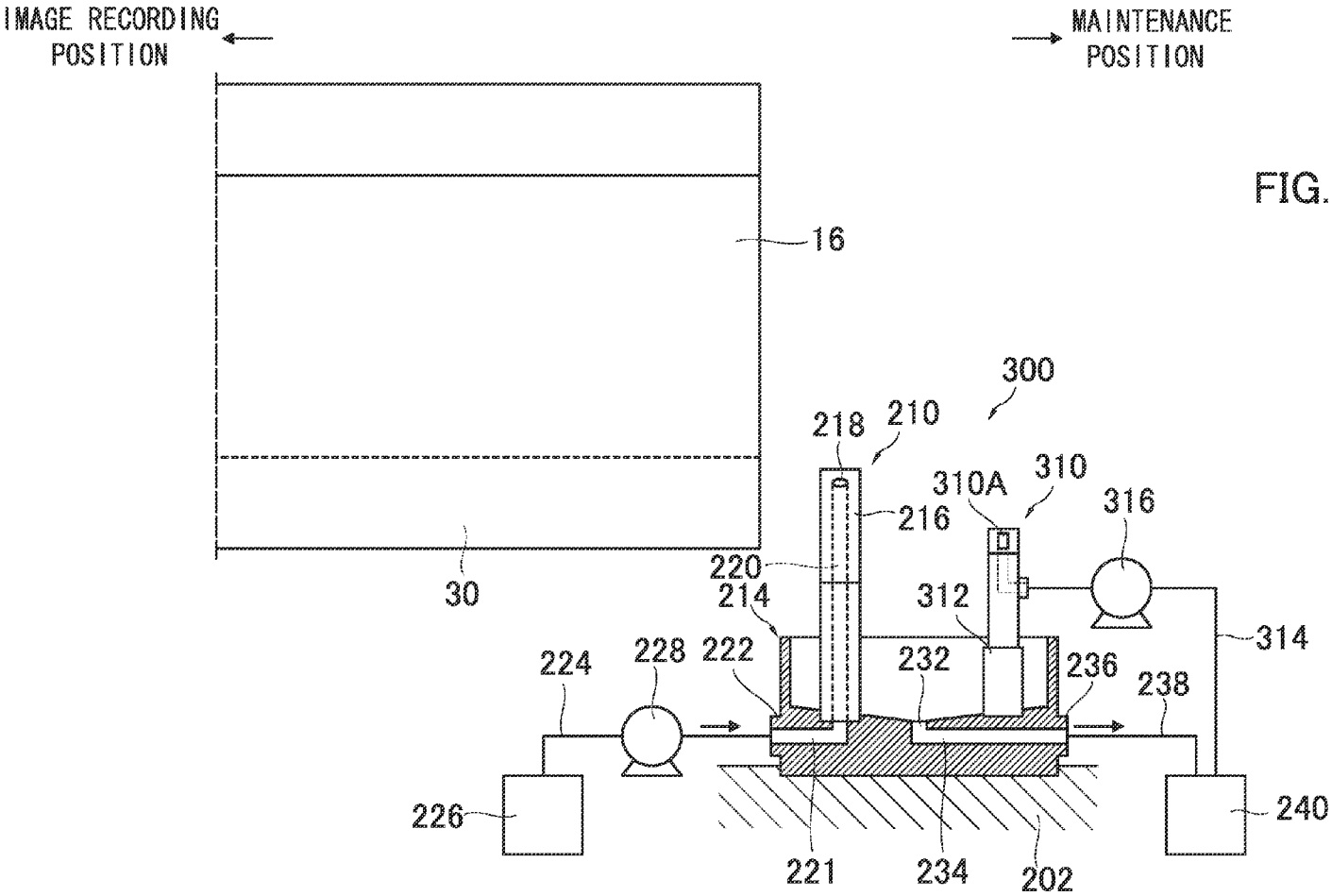
FIG. 19 is a front view diagram showing a composition of a cleaning liquid deposition unit which is arranged in the nozzle surface cleaning apparatus according to a second embodiment of the present invention.
Figure 20:
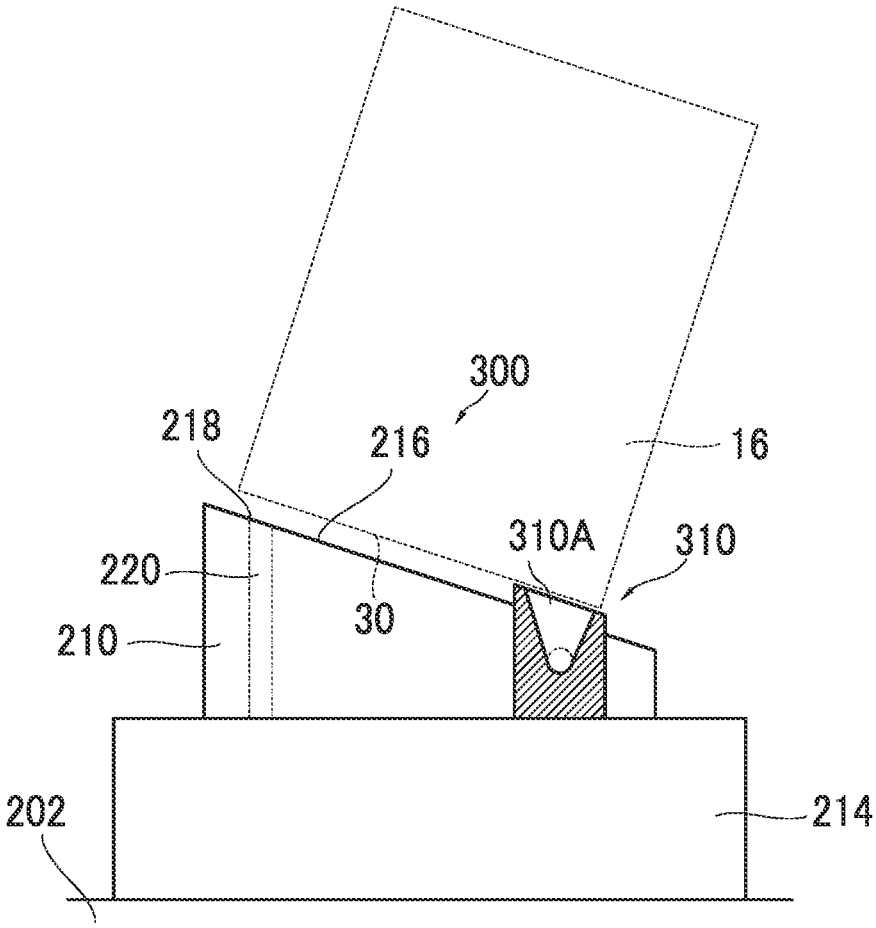
FIG. 20 is a side view diagram showing the cleaning liquid deposition unit in the second embodiment, as viewed from the maintenance position side.

FIG. 19 is a front view diagram showing a composition of the cleaning liquid deposition unit 300 which is arranged in the nozzle surface cleaning apparatus according to the second embodiment. FIG. 20 is a side view diagram showing the cleaning liquid deposition unit 300 viewed from the maintenance position side.

As shown in FIG. 19, a suction nozzle 310 is arranged instead of a squeegee in the cleaning liquid deposition unit 300 according to the present embodiment.

The suction nozzle 310 is vertically erected by being installed on a suction nozzle installation section 312, which is arranged inside the cleaning liquid recovery tray 214. The suction nozzle 310 is disposed so as to correspond to the position of the lower edge portion, in the direction of inclination, of the nozzle surface 30 that is being cleaned, and the upper end portion of the suction nozzle 310 is formed at an inclination corresponding to the angle of inclination of the nozzle surface 30 being cleaned.

A suction aperture 310A is formed on the upper end surface of the suction nozzle 310, and excess cleaning liquid which has collected on the lower edge portion of the nozzle surface 30 in the direction of inclination is suctioned through the suction aperture 310A.

The suction nozzle 310 is connected to the cleaning liquid recovery tank 240 through a suction channel 314. A suction pump 316 is arranged at an intermediate point of the suction channel 314, and by driving the suction pump 316, excess cleaning liquid is suctioned through the suction nozzle 310. The excess cleaning liquid suctioned through the suction nozzle 310 is recovered into the cleaning liquid recovery tank 240 through the suction channel 314.

A controller, which is not illustrated, controls the driving of the suction pump 316 and thereby controls the suctioning operation of the excess cleaning liquid by the suction nozzle 310.

The action of the cleaning liquid deposition unit 300 according to the present embodiment which has the composition described above is as follows.

When the cleaning liquid deposition unit 300 is set to the prescribed cleaning liquid deposition position, it is possible to suction and remove the excess cleaning liquid which has collected in the lower edge portion of the nozzle surface 30 in each of the inkjet heads, by means of the suction head 310. In other words, when the cleaning liquid deposition unit 300 is set to the cleaning liquid deposition position, the suction nozzle 310 is set to the position where it is possible to suction excess cleaning liquid which collects in the lower edge portion of the nozzle surface in the direction of inclination. More specifically, the suction nozzle 310 is set to the position which opposes the lower edge portion of the nozzle surface 30 in the direction of inclination, at a prescribed distance from same.

The deposition of the cleaning liquid is similar to the cleaning liquid deposition in the first embodiment. In other words, the cleaning liquid supply pump 228 is driven at the timing of the arrival of the inkjet head, the nozzle surface 30 is made to contact the cleaning liquid which has flowed down the cleaning liquid holding surface 216, and the cleaning liquid is thereby deposited onto the nozzle surface 30.

On the other hand, the removal of excess cleaning liquid is performed as described below.

The controller drives the suction pump 316 in accordance with the timing at which the inkjet head arrives at the suction nozzle 310. By this means, when the nozzle surface 30 passes the installation position of the suction nozzle 310, the lower edge portion of the nozzle surface 30 in the direction of inclination is applied with suction by the suction nozzle 310, and the excess cleaning liquid having been collected thereon is suctioned through the suction nozzle 310. Thereby, it is possible to remove the excess cleaning liquid.

Thus, in the nozzle surface cleaning apparatus according to the present embodiment, the excess cleaning liquid which has collected on the lower edge portion of the nozzle surface 30 in the direction of inclination is removed by suctioning through the suction nozzle 310. By this means, similarly to the nozzle surface cleaning apparatus according to the first embodiment described above, it is possible to prevent the excess cleaning liquid from dripping down during movement of the inkjet head and soiling the peripheral area. Furthermore, it is possible to prevent the wiping capability of the wiping webs 110 declining with the wiping step in the latter stage and giving rise to insufficient wiping.

It is desirable that the suction nozzle 310 of the present embodiment has a tip section formed in a V-shape and a suction hole faces also the side wall surface on the lower side of the inkjet head in the direction of inclination. Thereby, it is possible to remove the excess cleaning liquid more reliably.

Furthermore, in the nozzle surface cleaning apparatus according to the present embodiment, the cleaning liquid deposition head 210 and the suction nozzle 310 may also be arranged separately.

Third Embodiment

Figure 21:
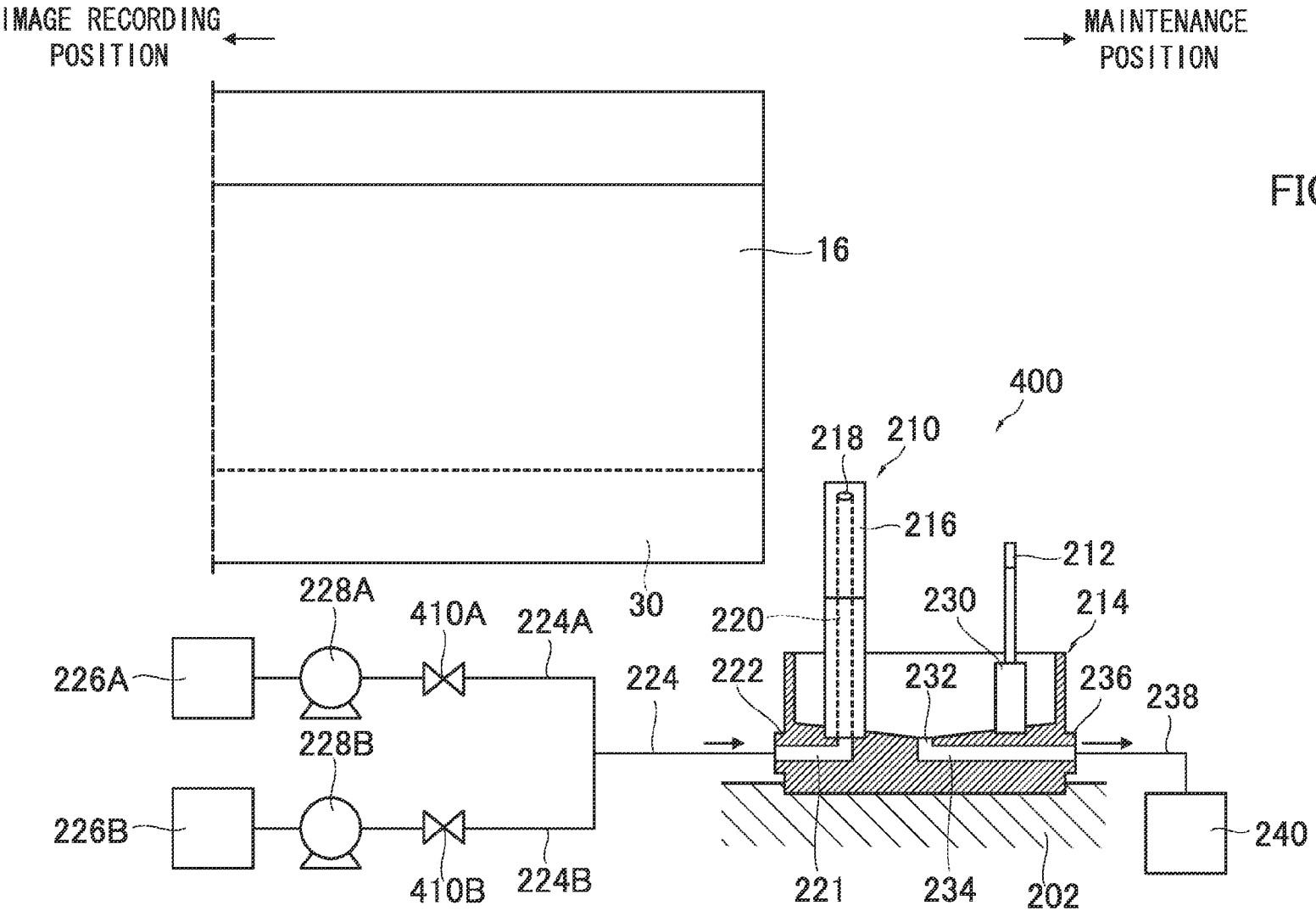
FIG. 21 is a front view diagram showing a composition of a cleaning liquid deposition unit which is arranged in the nozzle surface cleaning apparatus according to a third embodiment of the present invention.

FIG. 21 is a front view diagram showing a composition of a cleaning liquid deposition unit 400 which is arranged in the nozzle surface cleaning apparatus according to a third embodiment of the present invention.

The nozzle surface cleaning apparatus in the present embodiment is capable of switching the types of cleaning liquid deposited on the nozzle surface 30.

Apart from being devised so as to switch the cleaning liquid to be deposited, the composition of the cleaning liquid deposition unit 400 in the second embodiment is the same as the cleaning liquid deposition unit 200 in the above-described first embodiment, and therefore only the composition which enables switching of the cleaning liquid to be deposited is described here.

The cleaning liquid supply channel 224 is connected to the cleaning liquid support port 222, which is connected to the cleaning liquid deposition head 210. The cleaning liquid supply channel 224 is formed to branch into a first cleaning liquid supply channel 224A and a second cleaning liquid supply channel 224B at an intermediate point thereof.

The first cleaning liquid supply channel 224A is connected to a first cleaning liquid supply tank 226A, and a first cleaning liquid supply pump 228A and a first valve 410A are arranged at an intermediate point of the channel.

On the other hand, the second cleaning liquid supply channel 224B is connected to a second cleaning liquid supply tank 226B, and a second cleaning liquid supply pump 228B and a second valve 410B are arranged at an intermediate point of the channel.

Different types of cleaning liquid are stored respectively in the first cleaning liquid supply tank 226A and the second cleaning liquid supply tank 226B. In other words, a first cleaning liquid is stored in the first cleaning liquid supply tank 226A and a second cleaning liquid is stored in the second cleaning liquid supply tank 226B. In the present embodiment, normal cleaning liquid is used for the first cleaning liquid and diluted cleaning liquid is used for the second cleaning liquid.

The controller switches the cleaning liquid to be deposited onto the nozzle surface by controlling the driving of the first cleaning liquid supply pump 228A and the second cleaning liquid supply pump 228B, and the driving of the first valve 410A and the second valve 410B.

More specifically, when depositing the first cleaning liquid, the first valve 410A is opened, the second valve 410B is closed, and the first cleaning liquid supply pump 228A is driven. Thereby, the first cleaning liquid, which is stored in the first cleaning liquid supply tank 226A, is sent to the cleaning liquid deposition head 210 and the first cleaning liquid flows out from the cleaning liquid emission port 218 of the cleaning liquid deposition head 210.

On the other hand, when depositing the second cleaning liquid, the second valve 410B is opened, the first valve 410A is closed, and the second cleaning liquid supply pump 228B is driven. Thereby, the second cleaning liquid, which is stored in the second cleaning liquid supply tank 226B, is sent to the cleaning liquid deposition head 210 and the second cleaning liquid flows out from the cleaning liquid emission port 218 of the cleaning liquid deposition head 210.

Thus, according to the nozzle surface cleaning apparatus of the present embodiment, it is possible to switch the types of cleaning liquid deposited on the nozzle surface 30. By this means, it is possible to use suitable cleaning liquid in accordance with the extent of soiling of the nozzle surface 30, and the nozzle surface 30 can be cleaned efficiently. More specifically, for example, if the extent of soiling is high, then cleaning is performed using the first cleaning liquid, and if the extent of soiling is low, then cleaning is performed using the second cleaning liquid, whereby it is possible to clean the nozzle surface 30 efficiently in accordance with the extent of soiling.

Fourth Embodiment

Figure 22:
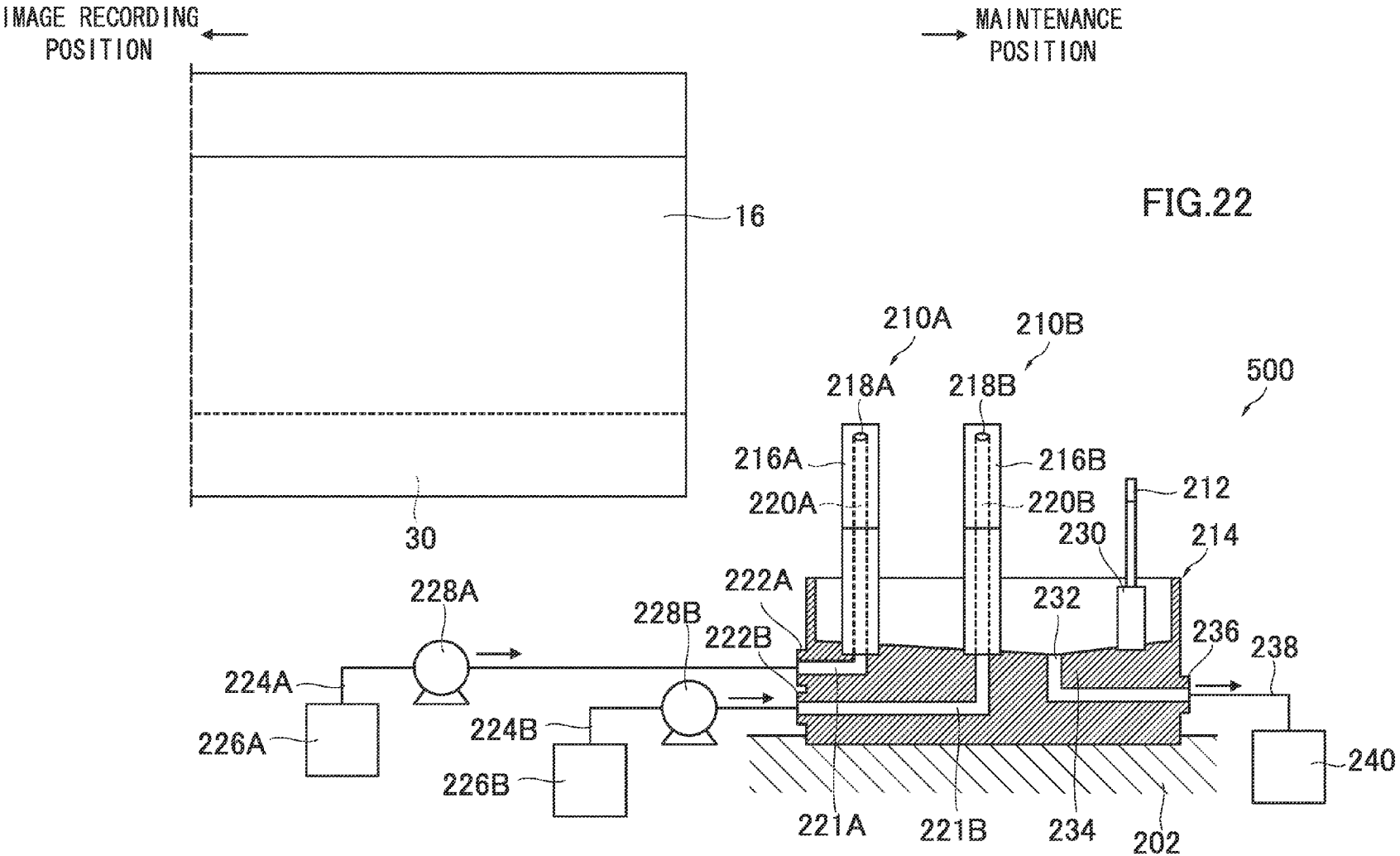
FIG. 22 is a front view diagram showing a composition of a cleaning liquid deposition unit which is arranged in the nozzle surface cleaning apparatus according to a fourth embodiment of the present invention.

FIG. 22 is a front view diagram showing a composition of a cleaning liquid deposition unit 500 which is arranged in the nozzle surface cleaning apparatus according to the fourth embodiment of the present invention.

The cleaning liquid deposition unit 500 in the present embodiment differs from the cleaning liquid deposition unit 200 in the first embodiment described above in that a plurality of cleaning liquid deposition heads are arranged. Consequently, only this point is described here.

As shown in FIG. 22, in the cleaning liquid deposition unit 500 according to the present embodiment, the first cleaning liquid deposition head 210A and the second cleaning liquid deposition head 210B, which have the same composition, are arranged in parallel in the direction of movement of the inkjet head. More specifically, the first cleaning liquid deposition head 210A is on the image recording position side, and the second cleaning liquid deposition head 210B is on the maintenance position side.

In this case, the squeegee 212 is arranged to the side of the maintenance position from the second cleaning liquid deposition head 210B.

The composition of the first cleaning liquid deposition head 210A and the second cleaning liquid deposition head 210B is the same as the composition of the cleaning liquid deposition head 210 in the first embodiment which has been described above. In other words, each of the first and second cleaning liquid deposition heads 210A and 210B is formed in a rectangular block shape having an inclined upper surface, and a cleaning liquid holding surface parallel to the nozzle surface 30 is formed on top of same. The cleaning liquid holding surface of the first cleaning liquid deposition head 210A is taken to be a first cleaning liquid holding surface 216A, and the cleaning liquid holding surface of the second cleaning liquid deposition head 210B is taken to be a second cleaning liquid holding surface 216B.

Furthermore, the cleaning liquid emission port is formed in the vicinity of the upper part of the cleaning liquid holding surface, and the cleaning liquid flows out from the cleaning liquid emission port. The cleaning liquid emission port of the first cleaning liquid deposition head 210A is taken to be a first cleaning liquid emission port 218A, and the cleaning liquid emission port of the second cleaning liquid deposition head 210B is taken to be a second cleaning liquid emission port 218B.

The cleaning liquid supply flow channel connected to the cleaning liquid emission port is formed inside the cleaning liquid deposition head. The cleaning liquid supply flow channel of the first cleaning liquid deposition head 210A is taken to be a first cleaning liquid supply flow channel 220A, and the cleaning liquid supply flow channel of the second cleaning liquid deposition head 210B is taken to be a second cleaning liquid supply flow channel 220B.

A first connection flow channel 221A, which connects to the first cleaning liquid supply flow channel 220A, and a second connection flow channel 221B, which connects to the second cleaning liquid supply flow channel 220B, are formed in the cleaning liquid recovery tray 214, and furthermore a first cleaning liquid supply port 222A, which connects to the first connection flow channel 221A, and a second cleaning liquid supply port 222B, which connects to the second connection flow channel 221B, are also formed in the cleaning liquid recovery tray 214.

The first cleaning liquid supply tank 226A is connected to the first cleaning liquid supply port 222A through the first cleaning liquid supply channel 224A. The first cleaning liquid supply pump 228A is arranged at an intermediate point of the first cleaning liquid supply channel 224A, and by driving the first cleaning liquid supply pump 228A, the first cleaning liquid stored in the first cleaning liquid supply tank 226A is supplied to the first cleaning liquid supply port 222A. Due to the first cleaning liquid being supplied to the first cleaning liquid supply port 222A, the first cleaning liquid flows out from the first cleaning liquid emission port 218A of the first cleaning liquid deposition head 210A.

On the other hand, the second cleaning liquid tank 226B is connected to the second cleaning liquid supply port 222B through the second cleaning liquid supply channel 224B. The second cleaning liquid supply pump 228B is arranged at an intermediate point of the second cleaning liquid supply channel 224B, and by driving the second cleaning liquid supply pump 228B, the second cleaning liquid stored in the second cleaning liquid supply tank 226B is supplied to the second cleaning liquid supply port 222B. Due to the second cleaning liquid being supplied to the second cleaning liquid supply port 222B, the second cleaning liquid flows out from the second cleaning liquid emission port 218B of the second cleaning liquid deposition head 210B.

A controller, which is not illustrated, controls the driving of the first cleaning liquid supply pump 228A and the second cleaning liquid supply pump 228B, so as to control the supply of the first cleaning liquid to the first cleaning liquid deposition head 210A and the supply of the second cleaning liquid to the second cleaning liquid deposition head 210B.

According to the cleaning liquid deposition unit 500 in the present embodiment which is composed as described above, it is possible to alter the deposition volume and/or the type of cleaning liquid which is deposited on the nozzle surface 30. Thereby, it is possible to deposit the cleaning liquid appropriately, in accordance with the extent of soiling of the nozzle surface 30.

For example, if the cleaning liquid of the same type is stored in the first cleaning liquid supply tank 226A and the second cleaning liquid supply tank 226B (namely, if the first cleaning liquid is the same as the second cleaning liquid), then it is possible to deposit an appropriate amount of the cleaning liquid in accordance with the extent of soiling, by altering the number of cleaning liquid deposition heads used in accordance with the extent of soiling. For example, if there is little soiling, then the cleaning liquid is deposited on the nozzle surface 30 by using only one of the first cleaning liquid deposition head 210A and the second cleaning liquid deposition head 210B. On the other hand, if there is a large amount of soiling, then the cleaning liquid is deposited onto the nozzle surface 30 by using both the first cleaning liquid deposition head 210A and second cleaning liquid deposition head 210B.

Furthermore, for example, if the cleaning liquids of different types are stored in the first cleaning liquid supply tank 226A and the second cleaning liquid supply tank 226B (namely, if the first cleaning liquid is not the same as the second cleaning liquid), then it is possible to deposit an appropriate cleaning liquid in accordance with the extent of soiling, by being able to alter the cleaning liquid deposition head used in accordance with the extent of soiling. For instance, the normal cleaning liquid (first cleaning liquid) is stored in the first cleaning liquid supply tank 226A and the diluted cleaning liquid (second cleaning liquid) is stored in the second cleaning liquid supply tank 226B, and if there is little soiling, then the diluted cleaning liquid (second cleaning liquid) is deposited onto the nozzle surface 30 using the second cleaning liquid deposition head 210B. On the other hand, if there is a large amount of soiling, then the normal cleaning liquid (first cleaning liquid) is deposited onto the nozzle surface 30 by using the first cleaning liquid deposition head 210A.

In this way, according to the nozzle surface cleaning apparatus of the present embodiment, it is possible to switch the deposited amount and/or the type of cleaning liquid deposited on the nozzle surface 30, by providing the plurality of cleaning liquid deposition heads. Thus, it is possible to use a suitable volume or a suitable type of cleaning liquid in accordance with the extent of soiling of the nozzle surface 30, and the nozzle surface 30 can be cleaned efficiently. Moreover, it is also possible to restrict wasteful consumption of the cleaning liquid.

In the present embodiment, an example is described in which two cleaning liquid deposition heads are arranged, but the number of the cleaning liquid deposition heads arranged is not limited to this. Furthermore, in the present embodiment, the two cleaning liquid deposition heads are composed separately, but it is also possible to adopt a composition in which a plurality of cleaning liquid emission ports are arranged in a single cleaning liquid deposition head.

Fifth Embodiment

The nozzle surface cleaning apparatus according to the fifth embodiment of the present invention varies the speed of movement of the inkjet head (speed of movement of the head supporting frame) in accordance with the extent of soiling of the nozzle surface. In other words, when the speed of movement of the inkjet head is changed, the time from the deposition of the cleaning liquid by the cleaning liquid deposition device 62 until the wiping by the wiping device 64 changes, the time during which the cleaning liquid is present on the nozzle surface changes, and therefore the cleaning capability also varies.

Consequently, it is possible to clean the nozzle surface appropriately by changing the speed of movement of the inkjet head in accordance with the extent of soiling of the nozzle surface. For example, if there is a large amount of soiling, the speed of movement of the inkjet head is slowed, thereby increasing the time during which the cleaning liquid is present on the nozzle surface and raising the cleaning properties.

Apart from being able to change the speed of movement of the inkjet head, the composition of the nozzle surface cleaning apparatus in the fifth embodiment is the same as that of the nozzle surface cleaning apparatus in the above-described first embodiment, and therefore only the cleaning method is described here.

As stated previously, the head supporting frame 40 on which the inkjet heads 16C, 16M, 16Y and 16K are installed is driven by the linear drive mechanism (for example, the screw feed mechanism, or the like), which is not illustrated, and thereby moved between the image recording position and the maintenance position. The present embodiment adopts a composition whereby the speed of movement of the head supporting frame 40 can be altered (for example, if the linear drive mechanism is constituted of the screw feed mechanism, then the speed of rotation of the feed screw is variable). The linear drive mechanism moves the inkjet heads 16C, 16M, 16Y and 16K (by moving the head supporting frame 40) at a speed of movement corresponding to an instruction from the controller.

In the present embodiment, a composition is adopted in which the inkjet heads 16C, 16M, 16Y and 16K can be moved at either at a first speed of movement V1 or a second speed of movement V2 (V1>V2).

FIG. 23 is a table showing cleaning patterns implemented by the control unit.

As shown in FIG. 23, during normal cleaning, the inkjet heads 16C, 16M, 16Y and 16K are moved at the first movement speed V1. On the other hand, if there is a large amount of soiling, then the inkjet heads 16C, 16M, 16Y and 16K are moved at the second movement speed V2, which is slower than the first movement speed V1.

As described above, by slowing the speed of movement of the inkjet heads 16C, 16M, 16Y and 16K, the time from deposition of the cleaning liquid by the cleaning liquid deposition device 62 until wiping by the wiping device 64 becomes longer, and the time during which the cleaning liquid is present on the nozzle surface 30 can be increased. Thereby, it is possible to clean the nozzle surface 30 in an appropriate manner.

Thus, in the nozzle surface cleaning apparatus according to the present embodiment, it is possible to clean the nozzle surface appropriately by changing the speed of movement of the inkjet head in accordance with the extent of soiling of the nozzle surface.

In the example described above, the speed of movement of the inkjet head can be changed in two stages, but it is also possible to change the speed of movement in a greater number of stages. Furthermore, it is also possible to adopt a composition where a desired speed of movement can be set manually by an operator.

Moreover, in the example described above, the fifth embodiment is implemented in the nozzle surface cleaning apparatus which is provided with only one cleaning liquid deposition head (e.g., the nozzle surface cleaning apparatus according to the first embodiment), but it may also be implemented as described below in the nozzle surface cleaning apparatus which is provided with a plurality of cleaning liquid deposition heads.

FIG. 24 is a table showing cleaning patterns implemented by the controller in the nozzle surface cleaning apparatus which is provided with two cleaning liquid deposition heads (e.g., the nozzle surface cleaning apparatus according to the fourth embodiment).

In the present example, the cleaning liquid of the same type is deposited from the first cleaning liquid deposition head 210A and the second cleaning liquid deposition head 210B.

As shown in FIG. 23, during normal cleaning, the inkjet heads 16C, 16M, 16Y and 16K are moved at the first movement speed V1, and the cleaning liquid is deposited from only the first cleaning liquid deposition head 210A.

On the other hand, during strong cleaning, the inkjet heads 16C, 16M, 16Y and 16K are moved at the second movement speed V2 slower than the first movement speed V1, and the cleaning liquid is deposited from only the first cleaning liquid deposition head 210A.

Moreover, during finishing cleaning, the inkjet heads 16C, 16M, 16Y and 16K are moved at the first movement speed V1, and the cleaning liquid is deposited from both the first cleaning liquid deposition head 210A and the second cleaning liquid deposition head 210B.

Moreover, during strong finishing cleaning, the inkjet heads 16C, 16M, 16Y and 16K are moved at the second movement speed V2, and the cleaning liquid is deposited from both the first cleaning liquid deposition head 210A and the second cleaning liquid deposition head 210B.

In this way, it is possible to clean the nozzle surface more appropriately, by changing the combination of the number of cleaning liquid deposition heads used and the speed of movement of the inkjet heads.

In the example described above, the case is given in which the cleaning liquid of the same type is deposited from the first cleaning liquid deposition head 210A and the second cleaning liquid deposition head 210B, but it is also possible to deposit cleaning liquids of different types.

Other Embodiments

In the series of embodiments described above, the composition is adopted in which the nozzle surface cleaning apparatus 60 is fixed and the inkjet heads 16 are moved to perform deposition of the cleaning liquid and wiping, but it is also possible to adopt a composition in which the deposition of cleaning liquid and wiping are performed by moving the nozzle surface cleaning apparatus 60. Similarly, it is also possible to adopt a composition in which deposition of the cleaning liquid and wiping are performed by moving both the nozzle surface cleaning apparatus and the inkjet head. In this case, the nozzle surface cleaning apparatus 60 may be composed in such a manner that the cleaning liquid deposition device 62 and the wiping device 64 are moved in unison, or are moved separately.

Furthermore, in the series of embodiments described above, the case where the present invention is applied to the inkjet recording apparatus which records images on cut sheet of paper has been described, but the application of the present invention is not limited to this. The present invention can be applied similarly to any droplet ejection apparatus having a composition in which the nozzle surface of a droplet ejection head is inclined with respect to the horizontal plane, and in this case, similar action and beneficial effects can be achieved.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A nozzle surface cleaning apparatus configured to clean a nozzle surface of a droplet ejection head in which the nozzle surface is inclined with respect to a horizontal plane, the apparatus comprising:

a cleaning liquid deposition device which deposits cleaning liquid on the nozzle surface while moving relatively to the nozzle surface in a direction perpendicular to a direction of inclination of the nozzle surface;

an excess cleaning liquid removal device which removes excess cleaning liquid adhering to a lower edge portion of the nozzle surface in terms of the direction of inclination, while moving relatively to the nozzle surface in the direction perpendicular to the direction of inclination of the nozzle surface, the excess cleaning liquid being a part of the cleaning liquid deposited by the cleaning liquid deposition device, wherein the excess cleaning liquid removal device includes a squeegee which is pressed against only to the lower edge portion of the nozzle surface to sweep the excess cleaning liquid; and a wiping device which wipes the nozzle surface after the excess cleaning liquid is removed by the excess cleaning liquid removal device, while moving relatively to the nozzle surface in the direction perpendicular to the direction of inclination of the nozzle surface; and wherein the wiping device comprises a wiping web wrapped about a pressing roller and the pressing roller is supported by a pair of supporting sections in a rotatable fashion and swingably within a plane perpendicular to the direction of inclination of the nozzle surface.

2. The nozzle surface cleaning apparatus as defined in claim 1, wherein:

the cleaning liquid deposition device includes a cleaning liquid tray which receives the cleaning liquid falling down from the nozzle surface; and the excess cleaning liquid removal device sweeps the excess cleaning liquid into the cleaning liquid tray.

3. The nozzle surface cleaning apparatus as defined in claim 1, further comprising a cleaning liquid type switching device which switches types of the cleaning liquid to be deposited on the nozzle surface from the cleaning liquid deposition device.

4. The nozzle surface cleaning apparatus as defined in claim 1, wherein:

the cleaning liquid deposition device includes a plurality of cleaning liquid deposition units which deposit the cleaning liquid on the nozzle surface and are aligned in the direction perpendicular to the direction of inclination of the nozzle surface; and the nozzle surface cleaning apparatus further comprises a cleaning liquid deposition control device which controls deposition of the cleaning liquid onto the nozzle surface by individually controlling the cleaning liquid deposition units.

5. The nozzle surface cleaning apparatus as defined in claim 4, wherein the cleaning liquid deposition units respectively deposit the cleaning liquid of different types onto the nozzle surface.

6. The nozzle surface cleaning apparatus as defined in claim 1, further comprising a movement control device which controls and changes a speed of relative movement of the cleaning liquid deposition device and the excess cleaning liquid removal device with respect to the nozzle surface.

7. A droplet ejection apparatus, comprising:

the droplet ejection head in which the nozzle surface is inclined with respect to the horizontal plane; and the nozzle surface cleaning apparatus as defined in claim 1 which cleans the nozzle surface of the droplet ejection head.

8. The nozzle surface cleaning apparatus as defined in claim 1, wherein a nozzle forming surface is disposed in a central portion, in the direction of inclination, of the nozzle surface, nozzle protection surfaces are arranged on either side of the nozzle forming surface, and nozzles are arranged only in the nozzle forming surface.

9. The droplet ejection apparatus as defined in claim 7, wherein:

the droplet ejection head includes a line head having a length corresponding to a width of a medium; and the nozzle surface is inclined in a direction perpendicular to a lengthwise direction of the line head.

10. The nozzle surface cleaning apparatus as defined in claim 8, wherein a liquid repelling treatment is applied to the nozzle forming surface.

11. The nozzle surface cleaning apparatus as defined in claim 8, wherein the squeegee is pressed against only to a lower edge portion of the nozzle protection surface on lower side, in the direction of inclination, of the nozzle surface.

12. The droplet ejection apparatus as defined in claim 9, further comprising:

an image recording drum which conveys the medium while holding the medium on a circumferential surface thereof, wherein the nozzle surface is inclined to face the circumferential surface of the image recording drum.

13. The nozzle surface cleaning apparatus as defined in claim 10, wherein the squeegee is pressed against only to a lower edge portion of the nozzle protection surface on lower side, in the direction of inclination, of the nozzle surface.

* * * * *